US008208255B2

(12) United States Patent
Enomoto et al.

(10) Patent No.: US 8,208,255 B2
(45) Date of Patent: Jun. 26, 2012

(54) REMOTE CONTROL APPARATUS

(75) Inventors: Michito Enomoto, Fukuoka-ken (JP); Yoshiaki Mitsuno, Fukuoka-ken (JP); Shingo Hashimoto, Fukuoka-ken (JP); Takayuki Matsuo, Fukuoka-ken (JP); Masami Yamanaka, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 781 days.

(21) Appl. No.: 12/296,798

(22) PCT Filed: Apr. 11, 2007

(86) PCT No.: PCT/JP2007/058008

§ 371 (c)(1),
(2), (4) Date: Jan. 26, 2009

(87) PCT Pub. No.: WO2007/119758

PCT Pub. Date: Oct. 25, 2007

(65) Prior Publication Data

US 2009/0303670 A1 Dec. 10, 2009

(30) Foreign Application Priority Data

Apr. 13, 2006 (JP) ..... 2006-111402
May 31, 2006 (JP) ..... 2006-152790

(51) Int. Cl.
*G06F 1/16* (2006.01)
*H04N 5/44* (2006.01)
*H03K 17/94* (2006.01)
*B65D 85/00* (2006.01)

(52) U.S. Cl. ..... 361/679.56; 361/679.55; 361/679.01; 348/734; 341/22; 341/34; 206/320

(58) Field of Classification Search ..... 361/679.01–679.45, 679.55–679.59; 348/734; 341/22, 23, 34, 35, 176; 345/156, 345/157, 168, 169, 905; 206/320, 302.2, 206/305, 145 R; 455/575.1, 575.3
See application file for complete search history.

(56) References Cited

U.S. PATENT DOCUMENTS 4,745,397 A * 5/1988 Lagerbauer et al. ..... 341/23
(Continued)

FOREIGN PATENT DOCUMENTS

GB 2225451 A 5/1990
(Continued)

OTHER PUBLICATIONS

Supplemental European Search Report for 07741444 dated Jan. 5, 2011.

(Continued)

*Primary Examiner* — Jayprakash N Gandhi
*Assistant Examiner* — Nidhi Desai
(74) *Attorney, Agent, or Firm* — Pearne & Gordon LLP

(57) ABSTRACT

A remote control apparatus of the invention is a remote control apparatus for operating electronic hardware, including: a remote control main body; a cover covering a front surface of the remote control main body; and a plurality of switches provided on at least one of the remote control main body or the cover and switching by pressing force, the cover being openably attached to the remote control main body and covering the front surface of the remote control main body when closed and exposing the front surface when opened, one part of the cover being pressed to the remote control main body in the closed state of the cover and thereby being displaced to the remote control main body, and by the displacement, the cover or the remote control main body pressing any one of the plurality of switches, and another part of the cover being pressed to the remote control main body in the closed state of the cover and thereby being displaced to the remote control main body, and by the displacement, the cover or the remote control main body pressing another one of the plurality of switches. This invention can provide a remote control apparatus having excellent operability and excellent cleaning operability. Alternatively, a plurality of switches can be operated in the state of being covered with a cover.

13 Claims, 34 Drawing Sheets

U.S. PATENT DOCUMENTS

| | | | | |
|---|---|---|---|---|
| 5,092,459 | A | 3/1992 | Uljanic et al. | |
| 5,436,625 | A * | 7/1995 | Kubo | 341/22 |
| 5,831,555 | A * | 11/1998 | Yu et al. | 341/26 |
| 6,134,102 | A * | 10/2000 | Worn et al. | 361/679.3 |
| 6,902,332 | B2 * | 6/2005 | McLoone | 400/472 |
| 7,123,242 | B1 * | 10/2006 | Henty | 345/169 |
| 7,911,773 | B2 * | 3/2011 | Eromaki et al. | 361/679.16 |
| 2006/0170569 | A1 * | 8/2006 | Kubo et al. | 341/22 |
| 2008/0242360 | A1 * | 10/2008 | Jang et al. | 455/566 |

FOREIGN PATENT DOCUMENTS

| | | | |
|---|---|---|---|
| JP | 60-177429 | | 11/1985 |
| JP | 01-122232 | | 8/1989 |
| JP | 02-128320 | | 10/1990 |
| JP | 04-58924 | | 5/1992 |
| JP | 05-032470 | A | 4/1993 |
| JP | 06-093642 | | 4/1994 |
| JP | 06-136805 | | 5/1994 |
| JP | 06-189383 | A | 7/1994 |
| JP | 07-324534 | | 12/1995 |
| JP | 09-319492 | A | 12/1997 |
| JP | 10-247435 | A | 9/1998 |
| JP | 11-071799 | A | 3/1999 |
| JP | 11-213799 | A | 8/1999 |
| JP | 11-231972 | A | 8/1999 |
| JP | 11213799 | A * | 8/1999 |
| JP | 2000-217175 | | 8/2000 |
| JP | 2001-011921 | A | 1/2001 |
| JP | 2001-132046 | | 5/2001 |
| JP | 2002-025379 | | 1/2002 |
| JP | 2002-294797 | A | 10/2002 |
| JP | 2003-105832 | | 4/2003 |
| JP | 2003-223828 | A | 8/2003 |
| JP | 2005-184130 | A | 7/2005 |
| JP | 2005-192047 | A | 7/2005 |
| JP | 2005-217298 | A | 8/2005 |
| JP | 2005-277557 | | 10/2005 |
| WO | 99/62287 | A2 | 12/1999 |

OTHER PUBLICATIONS

Taiwan IPO Search Report for 96113096 dated Nov. 29, 2010.
International Search report for PCT/JP2007/058008, dated May 1, 2008.

* cited by examiner

REMOTE CONTROL APPARATUS

TECHNICAL FIELD

This invention relates to a remote control apparatus, for example, a remote control apparatus for operating electronic hardware such as a sanitary cleansing apparatus mounted on a toilet apparatus.

BACKGROUND ART

In general, in a remote control apparatus for operating electronic hardware, a display portion composed of a display panel and so forth and an operation portion composed of a plurality of operation buttons and so forth are provided. In recent years, in a toilet, electronic hardware such as a sanitary cleansing apparatus for cleansing a derriere or the like of a user has been provided, and drainage in a toilet bowl, opening and closing of a toilet lid, or the like has been electronically controlled. Therefore, a remote control apparatus for operating the electronic hardware has been placed on a wall or the like of a toilet room.

There is widely known such a remote control apparatus in which out of buttons for performing various settings and operations provided in the remote control main body, only the main buttons of high operation frequency are exposed and the other buttons are covered with a cover.

For example, in Patent Document 1, there is disclosed a technique in which in a remote control apparatus of sanitary cleansing apparatus attached to a toilet apparatus, a cover attached openably to a remote control main body is provided. And, in the front surface of the remote control main body, a display portion for displaying operation contents or the like and a plurality of operation buttons are provided, and on the cover, a plurality of openings are formed, the display portion and the main operation buttons are exposed from the openings when the cover is closed. Thereby, the main operation buttons and the display portion are visible in the closed state of the cover, and when the cover is opened, more specific settings or the like can be performed. In the operation buttons exposed from the opening portions, there are the buttons having a shape projecting from the surface of the cover.

Moreover, in Patent Document 2, there is disclosed a technique that in the ceiling of the remote control apparatus, three toilet-seat opening and closing switches are disposed contiguously to one another, and a cover covering the three switches is provided, and a projection is locally formed only at a position corresponding to one switch in the inner surface of the cover. In Patent Document 1, thereby, by pressing the cover in the closed state of the cover, the projection contacts the switch of the largest operation frequency, specifically, the switch for making only the toilet lid be in the opening state out of the above-described three toilet-seat opening and closing switches, and thereby, only the switch can be operated.

Patent Document 1: JP 2003-105832A

Patent Document 2: JP 06-093642A (1994)

DISCLOSURE OF INVENTION

Problems to be Solved by the Invention

However, in the above-described conventional techniques, there are problems shown as follows. That is, in the remote control apparatus described in the Patent Document 1, a plurality of operation buttons are exposed in the front surface of the remote control apparatus, and therefore, selection of the operation buttons is difficult for a person who does not get used to the operation. Moreover, it is necessary for the user to select and push a relatively small operation button according to a function to be carried out. By the way, in the operation of the sanitary cleansing apparatus, the user operates the operation buttons in the state that the user sits down on the toilet seat of the sanitary cleansing apparatus, and the remote control apparatus is attached to any one of the right-side wall and the left-side wall according to the situation of the installation site, and therefore, it is desired to be easy to perform the operation with a hand other than the dominant hand. Furthermore, in such a case that the hand of the side in which the remote control is installed is injured, it is necessary to operate the buttons of the remote control apparatus with the opposite hand to the wall to which the remote control apparatus is attached, and therefore, the operability is desired to be more improved.

Moreover, in cleaning the remote control apparatus, if it is attempted to wipe the surface of the cover with a cloth or the like, the cloth comes to catch on the operation buttons projecting from the surface of the cover, and the buttons prevent the cleaning work.

Moreover, in the remote control apparatus described in Patent Document 2, only the switch of the largest operation frequency can be operated with the closed cover but the other switches cannot be operated with the closed cover. Specifically, the switch for making both of the toilet seat and the toilet lid be in the opening state and the switch for making both of the toilet seat and the toilet lid be in the closing state cannot be operated if the cover is not opened. That is, with the closed state of the cover, the plurality of switches cannot be selected and pushed according to purpose.

An object of this invention is to provide a remote control apparatus having excellent operability and excellent cleaning operability.

Alternatively, another object of this invention is to provide a remote control apparatus in which a plurality of switches can be operated in the state of being covered with a cover.

Solution to the Problems

According to an aspect of the invention, there is provided a remote control apparatus for operating electronic hardware, including: a remote control main body; a cover covering a front surface of the remote control main body; and a plurality of switches provided on at least one of the remote control main body or the cover and switching by pressing force, the cover being openably attached to the remote control main body and covering the front surface of the remote control main body when closed and exposing the front surface when opened, one part of the cover being pressed to the remote control main body in the closed state of the cover and thereby being displaced to the remote control main body, and by the displacement, the cover or the remote control main body pressing any one of the plurality of switches, and another part of the cover being pressed to the remote control main body in the closed state of the cover and thereby being displaced to the remote control main body, and by the displacement, the cover or the remote control main body pressing another one of the plurality of switches.

BRIEF DESCRIPTION OF DRAWINGS

FIG. 1A shows a state in which the cover is closed and FIG. 1B shows a state in which the cover is opened.

DESCRIPTION OF REFERENCE NUMERALS

Figure 1A:
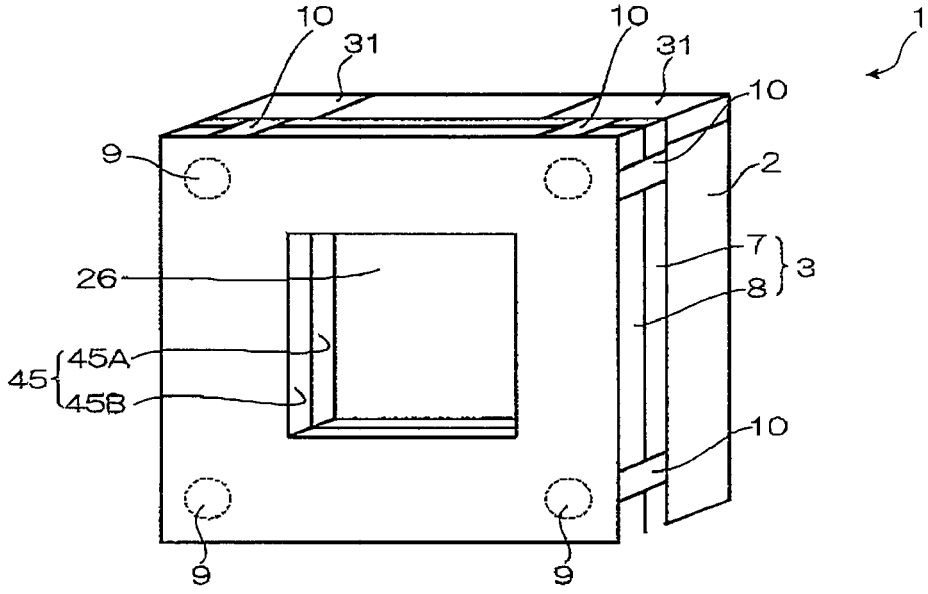
FIGS. 1A and 1B are perspective views illustrating a remote control apparatus according to a first embodiment of this invention.

1, 1*a*, 1*b*, 1*c*, 1*d*, 1*e*, 1*f*, 1*g*, 1*h* remote control apparatus
2 remote control main body
3, 3*h* cover
4 hinge
5 control substrate
6 switch
7 lower panel
8 upper panel
9 bias means
10 regulation means
11 projection
12 hole
13 control substrate
14 control line
15, 16 projection
17 resin plate
18 rib
21 remote control apparatus
22 remote control main body
23 cover
24 hinge
25 switch
26 display portion
26*a* LED
26*b* light guide plate
26*c* crystal display panel
26*d* protection plate
27 switch
27*a* key top
27*b* contact portion
27*c* front surface plate
27*d* pressing portion
27*e* locking portion
27*f* step
27*g* end
28 switch
29 surface sheet
30 switch
31 transmission portion
41 lower panel
42 upper panel
43 U-shaped portion

44 engaging portion
45, 45A, 45B opening portion
46 concave portion
47 back surface plate
48 hanger
49 top plate
49*a* extending portion
49*b* jutting portion
50 support counter
51 opening portion
52 rib
53 hole
54 spring
56 projecting portion
57 opening portion
60 region
61 direction
62 direction
63 region
64 region
71 remote control apparatus
73 cover
74 resin plate
75 opening portion
76 projection
77 resin plate
78 rib
79 concave portion
80 region
100 sanitary cleansing apparatus
200 toilet seat
300 toilet lid
310 transmissive window
400 main body
420 seating sensor
440 exhaust port
450 ejection hole
500 human body detection sensor
800 toilet bowl

BEST MODE FOR CARRYING OUT THE INVENTION

Hereinafter, embodiments of this Invention will be explained with reference to drawings.

First, a first embodiment of this invention will be explained.

Figure 1B:
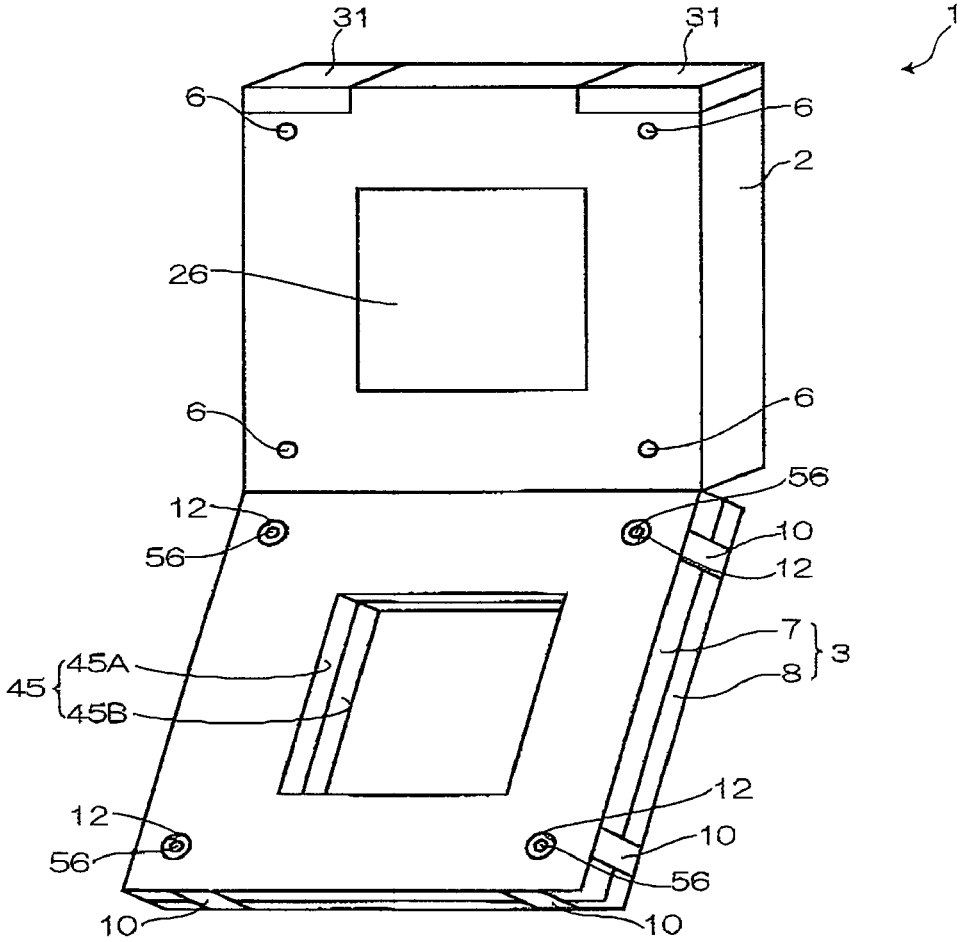

FIGS. 1A and 1B are perspective views illustrating a remote control apparatus according to a first embodiment of this invention, and FIG. 1A shows a state in which the cover is closed and FIG. 1B shows a state in which the cover is opened.

A remote control apparatus 1 according to this embodiment is a remote control apparatus for operating electronic hardware such as a sanitary cleansing apparatus mounted on a toilet apparatus and is disposed to be fixed to a wall of a toilet room.

As shown in FIGS. 1A and 1B, in the remote control apparatus 1 according to this embodiment, a remote control main body 2 and a cover 3 are provided. The cover 3 is attached openably to the remote control main body 2, and covers the front surface of the remote control main body 2 when closed, and exposes the front surface of the remote control main body 2 when opened. Viewed from the perpendicular direction to the wall surface (not shown) to which the remote control apparatus 1 is attached, a profile of the remote control main body 2 and a profile of the cover 3 are approximately matched, and both thereof are, for example, square. And, one end of the cover 3 is rotatably connected to a lower end of the remote control main body 2. Thereby, the cover 3 is rotatable in the range of about 180° so that the one end is the rotational center, and covers the remote control main body 2 in the upper position and exposes the remote control main body 2 in the lower position. Hereinafter, the direction from the remote control main body 2 to the cover 3 is referred to as "front" and the direction from the cover 3 to the remote control main body 2 referred to as "rear", in which the cover 3 is closed.

In four corners of the front surface of the remote control main body 2, switches 6 are provided, respectively. The switches 6 are switches operated by pressing force. To the switches 6, operations of high operation frequency such as operations of initiation and stop of discharge of bottom cleansing water out of the operations of the sanitary cleansing apparatus are assigned. Moreover, in the central portion of the front surface of the remote control main body 2, a display portion 26 is provided. The display 26 displays at least a part of operation contents of the sanitary cleansing apparatus or the like. Furthermore, in the remote control main body 2, a transmission portion 31 for transmitting a control signal representing the operation content to the electronic hardware such as the sanitary cleansing apparatus is provided.

In the front surface of the remote control main body 2, as well as the switches 6 and the display portion 26, switches (not shown) to which operations of low operation frequency such as operations of temperature setting of the bottom cleansing water and temperature setting of a toilet seat out of the operations of the sanitary cleansing apparatus are assigned may be provided. Moreover, in the upper surface of the remote control main body 2 that is not covered with the cover 3, switches for operations of high operation frequency used by a user in the standing state such as switches (not shown) for operating electronic hardware for controlling drainage in a toilet bowl and opening and closing of a toilet lid and so forth may be provided. Furthermore, the display portion 26 may be capable of displaying information of current time or battery remaining amount or the like or the display portion 26 may be capable of being brightened.

On the other hand, the cover 3 is composed so that a lower panel 7 disposed in the remote control main body 2 side when the cover 3 is closed, and an upper panel 8 disposed in the opposite side from the remote control main body 2 are superposed. The lower panel 7 is rotatably connected to the remote control main body 2, and is positioned with respect to the remote control main body 2 when the cover 3 is closed. Moreover, the upper panel 8 is supported by the lower panel 7.

In the lower panel 7, an opening portion 45A exposing the display portion 26 of the remote control main body 2 when the cover 3 is closed is formed. Moreover, in the lower panel 7, a bias means 9 for biasing the upper panel 8 to the separating direction from the lower panel 7 is provided and a regulation means 10 for regulating movement of the upper panel 8 to the separating direction from the lower panel 7. And, by the bias means 9 and the regulation means 10, the position of the upper panel 8 to the lower panel 7 is maintained to be constant, for example, the upper panel 8 is held to be in parallel to the lower panel 7. Furthermore, in the four corners of the lower panel 7, holes 12 are formed.

In the upper panel 8, an opening portion 45B exposing the display portion 26 of the remote control main body 2 when the cover 3 is closed is formed. The opening portion 45A of the lower panel 7 and the opening portion 45B of the upper panel 8 are formed in the position to be matched to each other, and by both of the opening portions, an opening portion 45 of the cover 3 is composed. Moreover, in the four corners of the upper panel 8, projection portions 56 projecting to the lower panel 7 are formed as switch operation means. The projection portions 56 are inserted through the holes 12 of the lower panel 7 and disposed in the positions to be matched to the switches 6 of the remote control main body 2. The switch operation means are not limited to the projection portions. For example, the cover 3 is in contact with the switches 6 and the switch operation means may be a contacting site of the cover 3 to the switches 6.

Next, operation of the remote control apparatus 1 according to this embodiment will be explained.

The remote control apparatus 1 is used generally in the closed state of the cover 3. In this case, the display portion 26 is exposed to the outside through the opening portion 45 of the cover 3 and a region except for the display portion 26 in the front surface of the remote control main body 2 is covered with the cover 3. And when the remote control apparatus 1 is not operated, the bias means 9 of the lower panel 7 biases the upper panel 8 to the separating direction from the lower panel 7, namely, makes bias to front, and on the other hand, the regulation means 10 regulates movement of the upper panel 8 to front. Thereby, the upper panel 8 is held to be, for example, in parallel to the lower panel 7. In this case, the projecting portions 56 of the upper panel 8 are inserted through the holes 12 of the lower panel 7 but do not press the switches 6.

In the state, when a user presses a corner of the upper panel 8 on the cover 3, the corner overcomes the biasing force of the bias means 9 and is displaced to the direction approaching the lower panel 7, and the upper panel slopes to the lower panel 7. Therefore, the projecting portion 56 positioned in the pressed corner contacts the switch 6 disposed in the corner through the hole 12, and thereby, presses the switch 6. As a result, the switch 6 is operated. As described above, when the cover 3 is closed, the cover 3 is pressed to the remote control main body 2 and thereby at least a part of the cover 3 is displaced to the remote control main body 2, and the projecting portion 56 provided at the displaced portion presses the switch 6. In this case, the projecting portions 56 disposed in the corners except for the pressed corner do not press the corresponding switches 6. The operation contents are communicated to a transmission portion 31, and the transmission portion 31 transmits the control signal representing the operation content to the sanitary cleansing apparatus or the like. Thereby, the sanitary cleansing apparatus or the like carries out the requested operation. In this case, the display portion 26 may display the operation content. And, when the user detaches the hand from the upper panel 8, the position of the upper panel 8 returns to be in the original state by the biasing force of the bias means 9 and thereby the switch 6 returns to be in the original state.

Next, effect of this embodiment will be explained.

As described above, according to this embodiment, by pressing some region of the upper panel 8 on the cover 3 in the state that the cover 3 covers the switch 6, the switch 6 can be operated, and therefore, compared to such a push button as a conventional technique, the pressing region that can operate the switch is drastically wide and the operability is improved. Moreover, through the opening portion 45 of the cover 3, the display portion 26 is visible. Therefore, the operation of high operation frequency can be performed in the closed sate of the cover 3. And, in cleaning the remote control apparatus 1, even when the front surface of the cover 3 is wiped with a cloth or the like, the cloth or the like do not catch and the cleaning operability is good because the switch 6 is covered with the cover 3 and the member projecting from the opening portion 45 of the cover 3 does not exist.

Next, a second embodiment of this invention will be explained.

Figure 2:
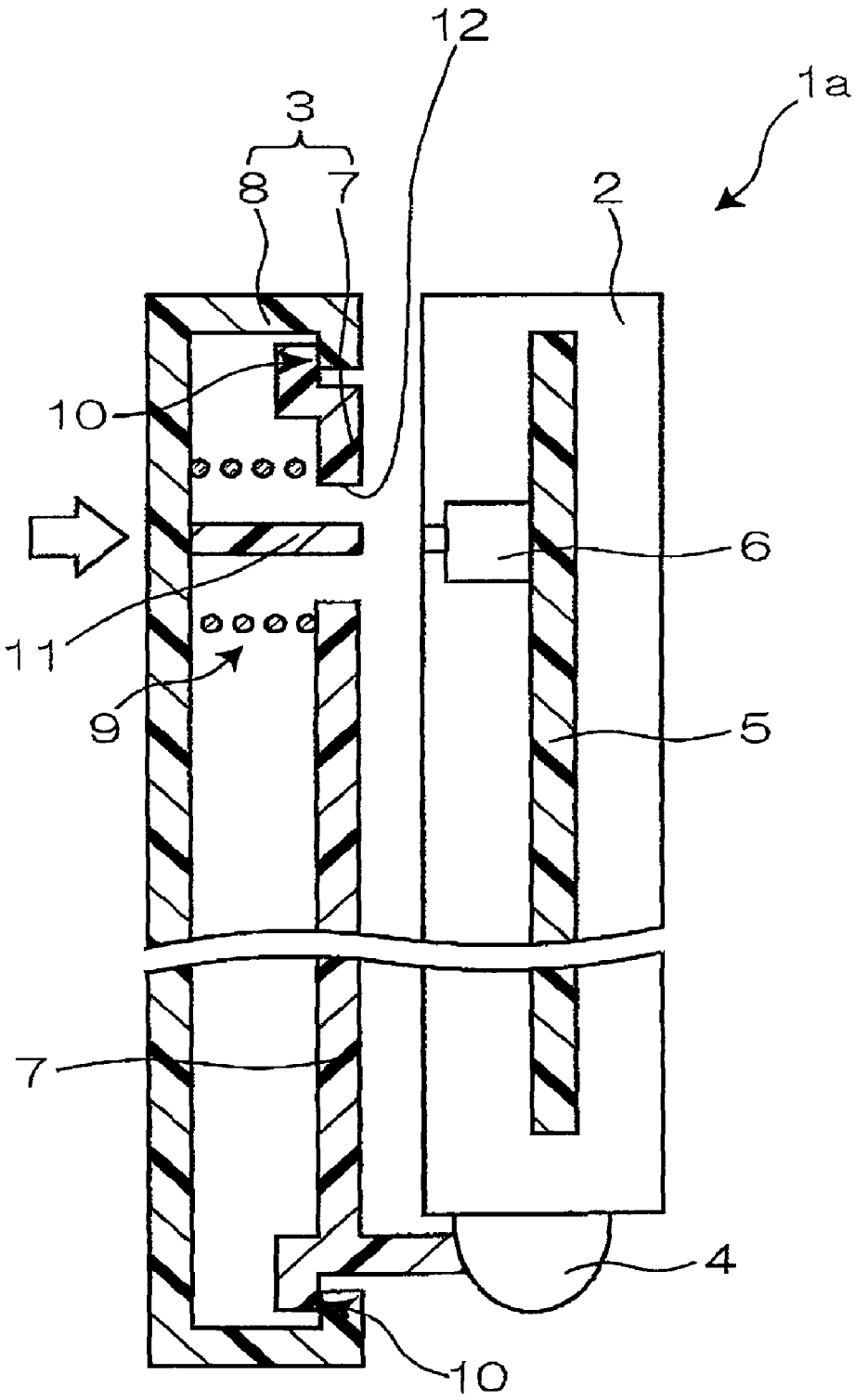
FIG. 2 is a sectional view illustrating a remote control apparatus according to a second embodiment of the invention.

FIG. 2 is a sectional view illustrating a remote control apparatus according to this embodiment.

A remote control apparatus 1*a* according to this embodiment is also a remote control apparatus for operating electronic hardware such as a sanitary cleansing apparatus mounted on a toilet apparatus and is disposed to be fixed to a wall of a toilet room.

As shown in FIG. 2, in the remote control apparatus 1*a* according to this embodiment, a remote control main body 2 and a cover 3 are provided. One end of the cover 3 is connected rotatably to the remote control main body 2 through a hinge 4 provided at the lower end of the remote control main body 2. Thereby, the cover 3 is rotatable in the range of about 180° so that the one end thereof is the rotational center, and covers the remote control main body 2 in the upper position and exposes the remote control main body 2 in the lower position. Moreover, viewed from the direction perpendicular to a wall surface (not shown) to which the remote control apparatus 1 is attached, for example, the profile of the remote control main body 2 and the profile of the cover 3 are approximately matched, and both thereof are, for example, square. Hereinafter, the direction from the remote control main body 2 to the cover 3 is referred to as "front" and the direction from the cover 3 to the remote control main body 2 referred to as "rear", in which the cover 3 is closed.

Inside the remote control main body 2, a control substrate 5 is provided and a plurality of switches 6 are provided on the front surface of the control substrate 5. The switches 6 are switches operated with being pressed. Moreover, the switches 6 are disposed, for example, in four corners of the remote control main body 2. To the switches 6, operations of high operation frequency such as operations of initiation and stop of discharge of bottom cleansing water out of the operations of the sanitary cleansing apparatus are assigned. Furthermore, in the remote control main body 2, a transmission portion (not shown) for transmitting a control signal representing the operation content to the electronic hardware such as the sanitary cleansing apparatus is provided.

In the front surface of the remote control main body 2, switches (not shown) to which operations of low operation frequency such as operations of temperature setting of the bottom cleansing water and temperature setting of the toilet seat out of the operations of the sanitary cleansing apparatus are assigned may be provided. Moreover, in the upper surface of the remote control main body 2 that is not covered with the cover 3, switches for operations of high operation frequency used by a user in the standing state such as switches (not shown) for operating electronic hardware for controlling drainage in the toilet bowl and opening and closing of the toilet lid and so forth may be provided. Furthermore, the display portion (not shown) displaying information of current time or a battery remaining amount or the like may be provided. The display portion may be capable of being brightened.

On the other hand, the cover 3 is composed so that a lower panel 7 disposed in the remote control main body 2 side when the cover 3 is closed and an upper panel 8 disposed in the opposite side from the remote control main body 2 are superposed. The lower panel 7 is rotatably connected to the remote control main body 2, and is positioned with respect to the remote control main body 2 when the cover 3 is closed. Moreover, the upper panel 8 is supported by the lower panel 7.

Moreover, in the cover 3, between the lower panel 7 and the upper panel 8, a bias means 9 for biasing the lower panel 7 and the upper panel 8 to the separating direction from each other is provided. The bias means 9 is composed of, for example, an elastic member made of a spring or rubber or the like, or one pair of magnets repulsive to each other. Furthermore, an outer edge of the upper panel 8 bends once backward and then bends to the direction approaching each other and form a U-shape. Thereby, when the upper panel 8 is biased to the separating direction from the lower panel 7 by the bias means 9, the outer edge of the lower panel 7 is locked by the U-shaped outer edge of the upper panel 8. That is, the outer edge of the lower panel 7 and the outer edge of the upper panel 8 function as a regulation means 10 for regulating the movement of the lower panel 7 and upper panel 8 to the separating direction from each other. And, by the bias means 9 and the regulation means 10, the distance between the lower panel 7 and upper panel 8 is held to be constant.

Furthermore, on the back surface of the upper panel 8, a plurality of projections 11 are formed. Furthermore, in the position matched to the projections 11 in the lower panel 7, holes 12 are formed. The projections 11 are inserted through the holes 12 and disposed in the positions matched to the switches 6 of the remote control main body 2 when the cover 3 is closed.

Next, the operation of the remote control apparatus 1*a* according to this embodiment will be explained.

The remote control apparatus 1*a* is used generally in the closed state of the cover 3. In this case, the front surface of the remote control main body 2 is covered with the cover 3. And when the remote control apparatus 1*a* is not operated, the bias means 9 biases the lower panel 7 and the upper panel 8 to the separating direction from each other, and on the other hand, the regulation means 10 regulates the movement of the lower panel 7 and the upper panel 8 to the separating direction from each other. Thereby, the upper panel 8 is maintained, for example, in the position that is parallel to the lower panel 7. In this case, the projections 11 of the upper panel 8 are inserted through the holes 12 of the lower panel 7 but do not press the switches 6.

The switch 6 is provided to be fixed to the remote control main body 2, and on the other hand, the lower panel 7 is positioned to the remote control main body 2 and the projection 11 is formed to be fixed to the upper panel 8. Therefore, the bias means 9 biases the lower panel 7 and the upper panel 8 to the separating direction from each other and thereby biases the switch 6 and the projection 11 to the separating direction from each other. Moreover, the regulation means 10 regulates the movement of the lower panel 7 and the upper panel 8 to the separating direction from each other and thereby regulates the movement of the lower panel 7 and the upper panel 8 to the separating direction from each other. As a result, by the bias means 9 and the regulation means 10, the distance between the switch 6 and the projection 11 is held to be constant.

In this state, when a user (not shown) presses a portion provided with the projection 11 in the upper panel 8 on the cover 3, the portion overcomes the biasing force of the bias means 9 and is displaced to the direction approaching the lower panel 7 so that the corresponding regulation means 10 is a support point, and thereby, the upper panel 8 is sloped to the lower panel 7. Therefore, the projection 11 positioned at the pressed portion contacts the switch 6 disposed in this region through the hole 12. As a result, the switch 6 is operated. As described above, when the cover 3 is closed, the cover 3 is pressed to the remote control main body 2 and thereby at least a part of the cover 3 is displaced to the remote control main body 2, and by the displacement, the projection 11 presses the switch 6. In this case, flow of the force applied by the user is the upper panel 8→the projection 11 (communication tool)→the switch 6. In this case, the projections 11 disposed in the portions except for the pressed portion do not press the corresponding switches 6.

The operation content is communicated to a transmission portion (not shown) and the transmission portion transmits the control signal representing the operation content to the sanitary cleansing apparatus or the like. Thereby, the sanitary cleansing apparatus or the like carries out the requested operation. In this case, the display portion (not shown) may display the operation content. And, when the user detaches the hand from the upper panel 8, the position of the upper panel 8 returns to be in the original state by the biasing force of the bias means 9 and thereby the switch 6 returns to be in the original state.

Next, effect of this embodiment will be explained.

As described above, according to this embodiment, by pressing the corresponding region to each of the switches 6 in the upper panel 8 on the cover 3 in the state that the cover 3 covers the switches 6, the switches 6 can be selected and pushed. As a result, compared to the case of directly pressing the switch 6, an area of the region that can be pressed can be extremely large, and therefore, the operability is extremely good. Moreover, compared to a conventional remote control apparatus described in Patent Document 1, the remote control apparatus according to this embodiment has high operability because a plurality of switches can be operated in the closed state of the cover.

Next, a third embodiment of this invention will be explained.

Figure 3:
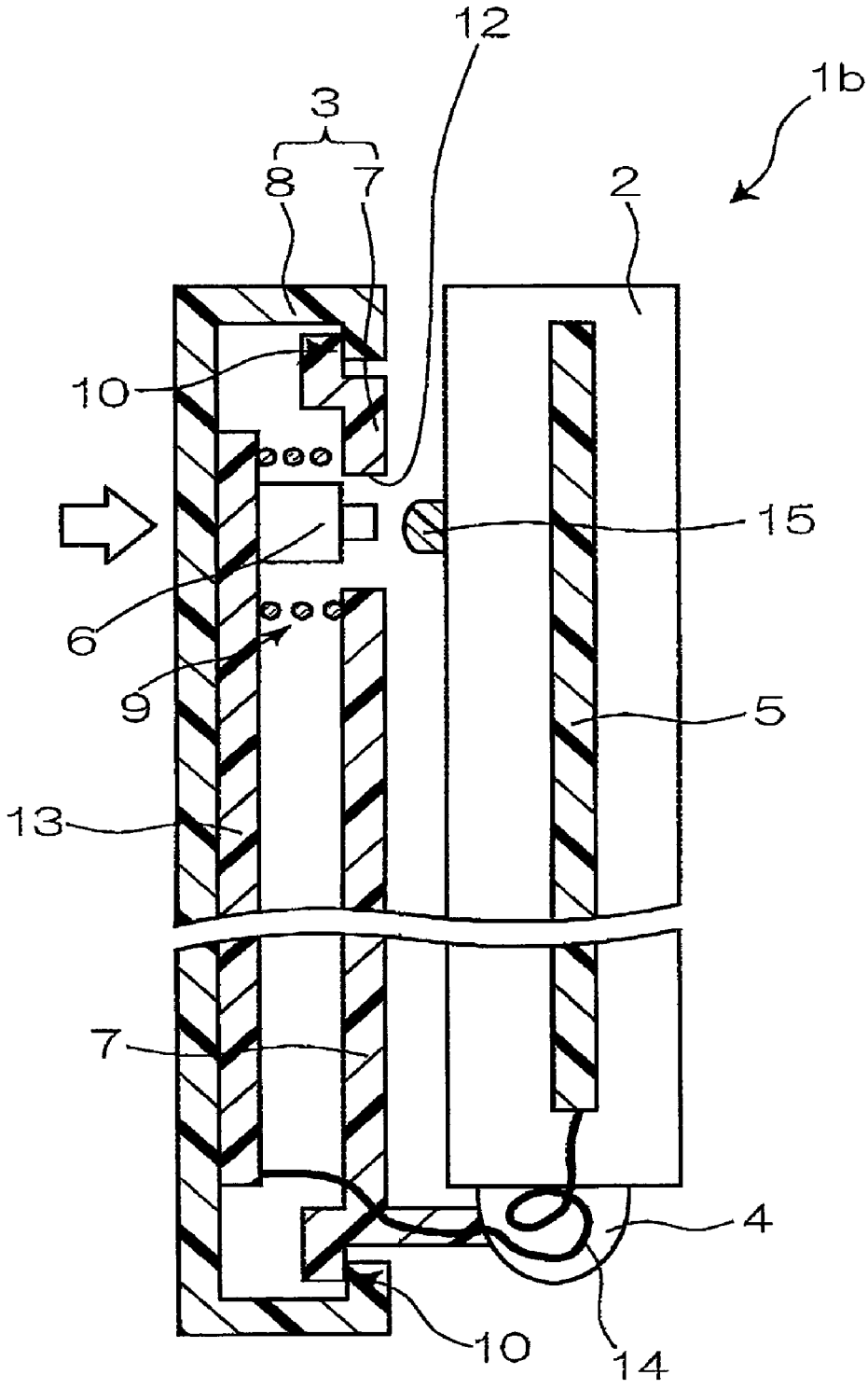
FIG. 3 is a sectional view illustrating a remote control apparatus according to a third embodiment of the invention.

FIG. 3 is a sectional view illustrating a remote control apparatus according to this embodiment.

As shown in FIG. 3, a remote control apparatus 1*b* according to this embodiment has different position and direction of arrangement of the switch 6 from those of the remote control apparatus 1*a* according to the above-described second embodiment (see, FIG. 2). That is, in the remote control apparatus 1*b*, on a back surface of the upper panel 8 of the cover 3 namely on a surface of the remote control main body 2 side, a control substrate 13 is provided. The control substrate 13 is connected to a control substrate 5 in the remote control main body 2 through a connective line 14. And, a plurality of switches 6 are provided on the back surface of the control substrate 13. Moreover, the operation surface of the switch 6 faces to rear, namely, to the remote control main body 2 side. Furthermore, a hole 12 is formed in the corresponding region to the switch 6 in the lower panel 7 and a plurality of projections 15 are formed on the front surface of the remote control main body 2. The projections 15 are disposed in the positions matched to the switches 6 in a closed state of the cover 3.

Thereby, when a user presses the portion provided with the switch 6 in the upper panel 8 to the remote control main body 12, the pressed portion on the upper panel 8 overcomes the biasing force of the bias means 9 and is displaced to the direction approaching the lower panel 7 so that the corresponding regulation means 10 is a support point. Thereby, the switch 6 positioned in the pressed portion contacts the projection 15 through the hole 12 and is pressed by the projection 15. In this case, flow of the force applied by the user is the upper panel 8→the switch 6 →the projection 15 (communication tool). The structures, operations, and effects except for the above-described ones in this embodiment are the same as the above-described second embodiment.

Next, a modified example of the third embodiment will be explained.

Figure 4:
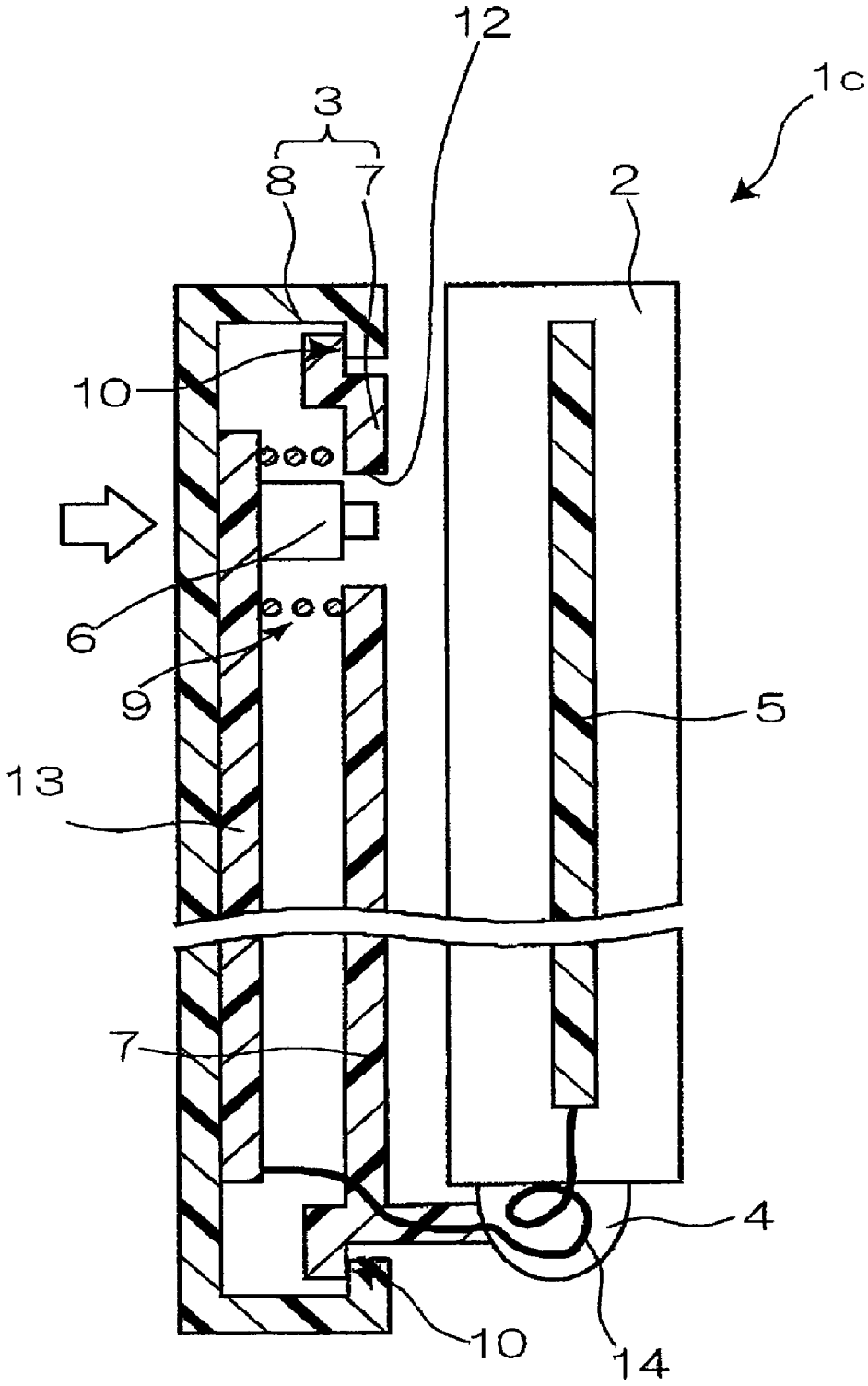
FIG. 4 is a sectional view illustrating a remote control apparatus according to a modified example of the third embodiment.

FIG. 4 is a sectional view illustrating a remote control apparatus according to this modified example.

As shown in FIG. 4, a remote control apparatus 1*c* according to this embodiment is different from the remote control apparatus 1*b* according to the above-described second embodiment (see, FIG. 3) in the point that the projection 15 (see FIG. 3) is not provided on the front surface of the remote control main body 2. In this case, when the upper panel 8 is pressed, the portion contacting the switch 6 becomes a part of the front surface of the remote control main body 2. The structures, operations, and effects except for the above-described ones in this modified example are the same as the above-described third embodiment.

Next, a fourth embodiment of this invention will be explained.

Figure 5:
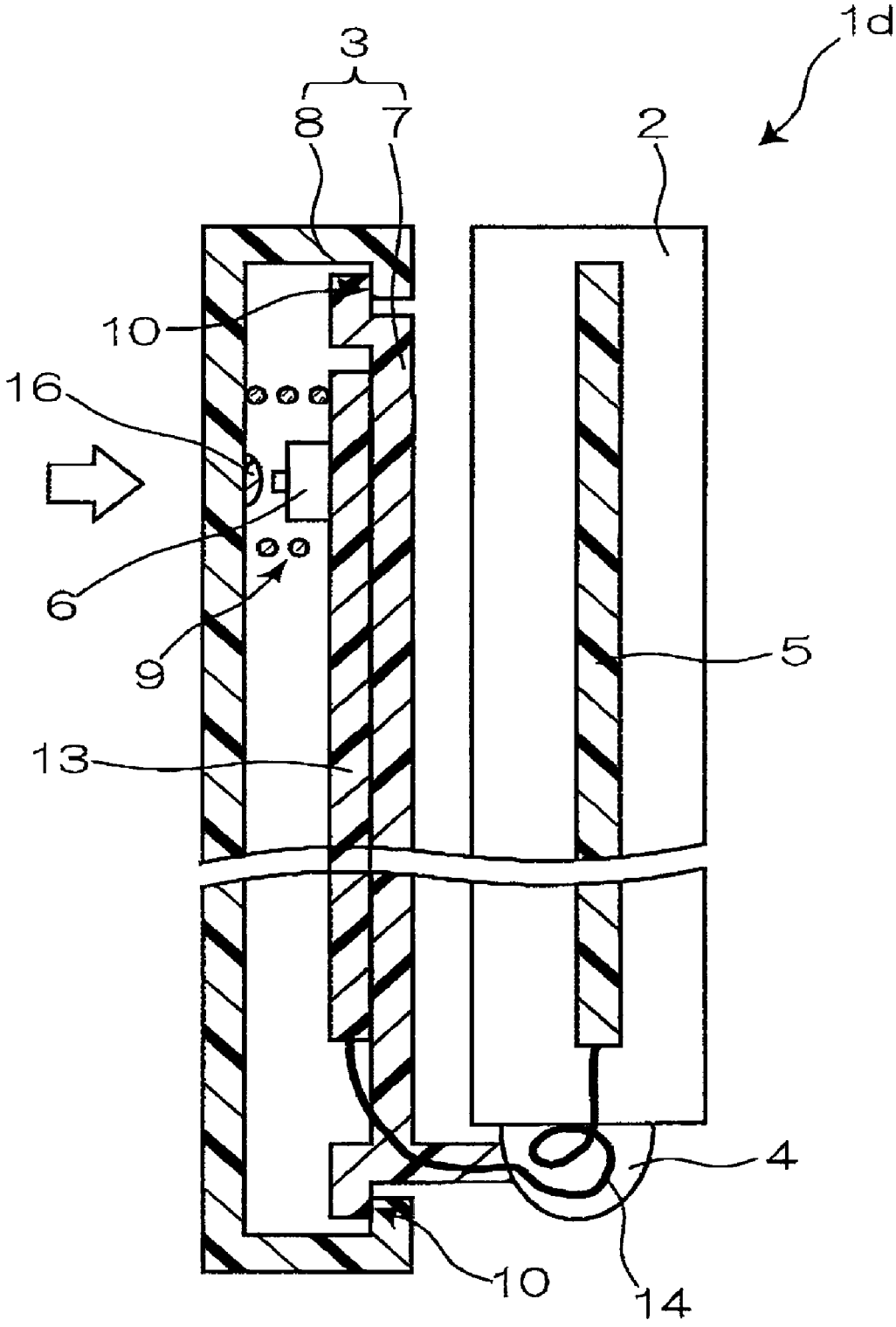
FIG. 5 is a sectional view illustrating a remote control apparatus according to a fourth embodiment of the invention.

FIG. 5 is a sectional view illustrating a remote control apparatus according to this embodiment.

As shown in FIG. 5, a remote control apparatus 1*d* according to this embodiment has different position of arrangement of the switch 6 from that of the remote control apparatus 1*a* according to the above-described second embodiment (see, FIG. 2). That is, in the remote control apparatus 1*d*, on a front surface of the lower panel 7 of the cover 3 namely on a surface of the upper panel 8 side, a control substrate 13 is provided. The control substrate 13 is connected to a control substrate 5 in the remote control main body 2 through a connective line 14. And, a plurality of switches 6 are provided on the front surface of the control substrate 13. Moreover, on the corresponding regions to switches 6 on the back surface of the upper panel 8, projections 16 are disposed. And, the bias means 9 is disposed between the lower panel 7 and the upper panel 8. Furthermore, the hole 12 (see, FIG. 2) is not formed in the lower panel 7 of the remote control apparatus 1*d*.

In this embodiment, when a user presses the portion provided with the projection 16 in the upper panel 8 to the remote control main body 12, the pressed portion on the upper panel 8 overcomes the biasing force of the bias means 9 and is displaced to the direction approaching the lower panel 7 so that the corresponding regulation means 10 is a support point. Thereby, the projection 16 positioned in the pressed portion contacts the switch 6 and presses the switch 6.

According to this embodiment, the switches 6, the bias means 9, and the control substrate 13 are involved in the space sealed to an extent, and therefore, the members can be prevented from being degraded by attachment of moisture and being contaminated. As a result, the remote control apparatus of little trouble and high reliability can be obtained. The structures, operations, and effects except for the above-described ones in this embodiment are the same as the above-described second embodiment.

Next, a modified example of the fourth embodiment will be explained.

Figure 6:
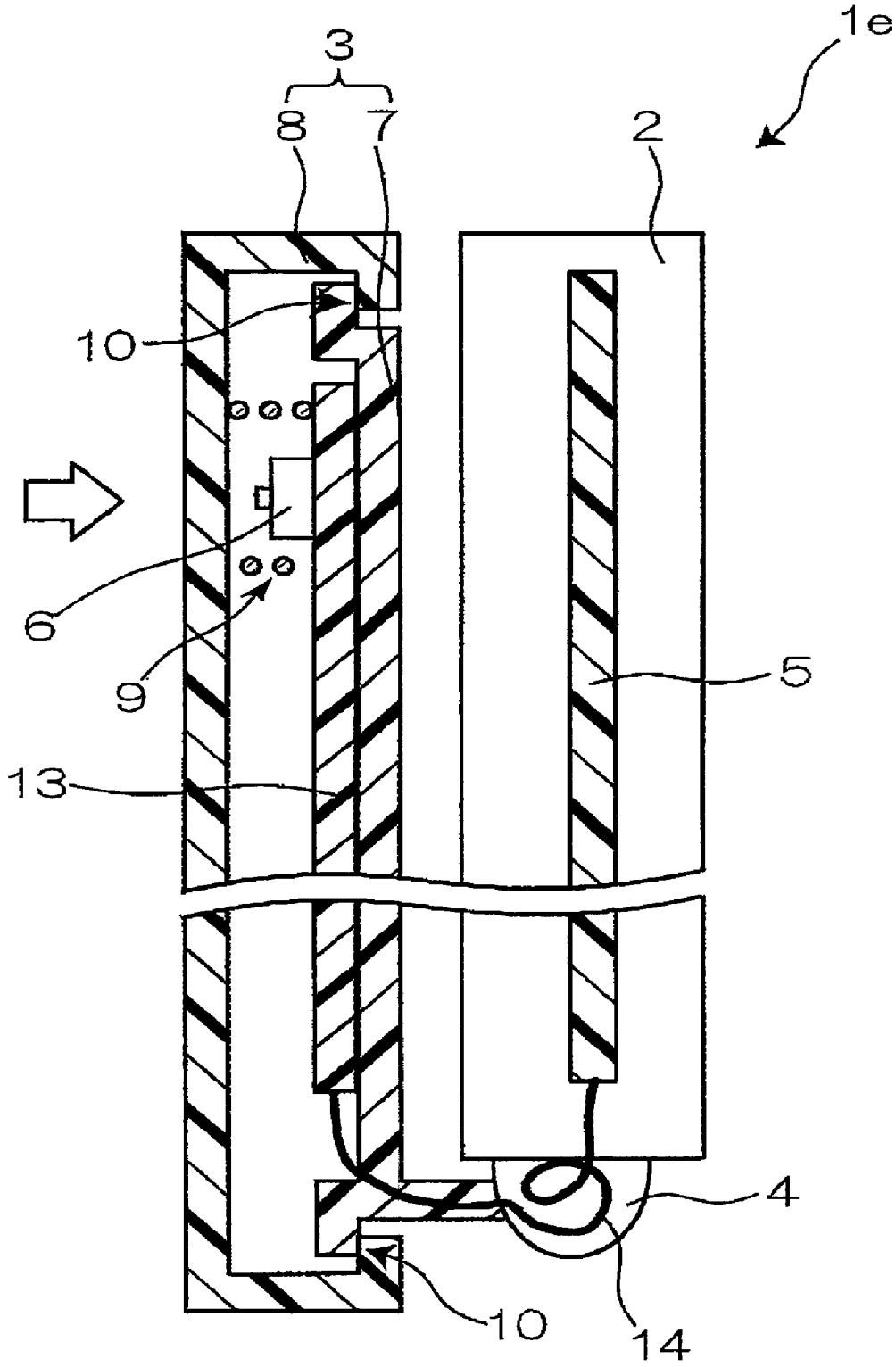
FIG. 6 is a sectional view illustrating a remote control apparatus according to a modified example of the fourth embodiment.

FIG. 6 is a sectional view illustrating a remote control apparatus according to this modified example.

As shown in FIG. 6, a remote control apparatus 1*e* according to this embodiment is different from the remote control apparatus 1*d* according to the above-described second embodiment (see, FIG. 5) in the point that the projection 16 (see FIG. 5) is not provided on the back surface of the upper panel 8. In this case, when the upper panel 8 is pressed, the portion contacting the switch 6 becomes a part of the upper panel 8. The structures, operations, and effects except for the above-described ones in this modified example are the same as the above-described fourth embodiment.

Next, a fifth embodiment of this invention will be explained.

Figure 7:
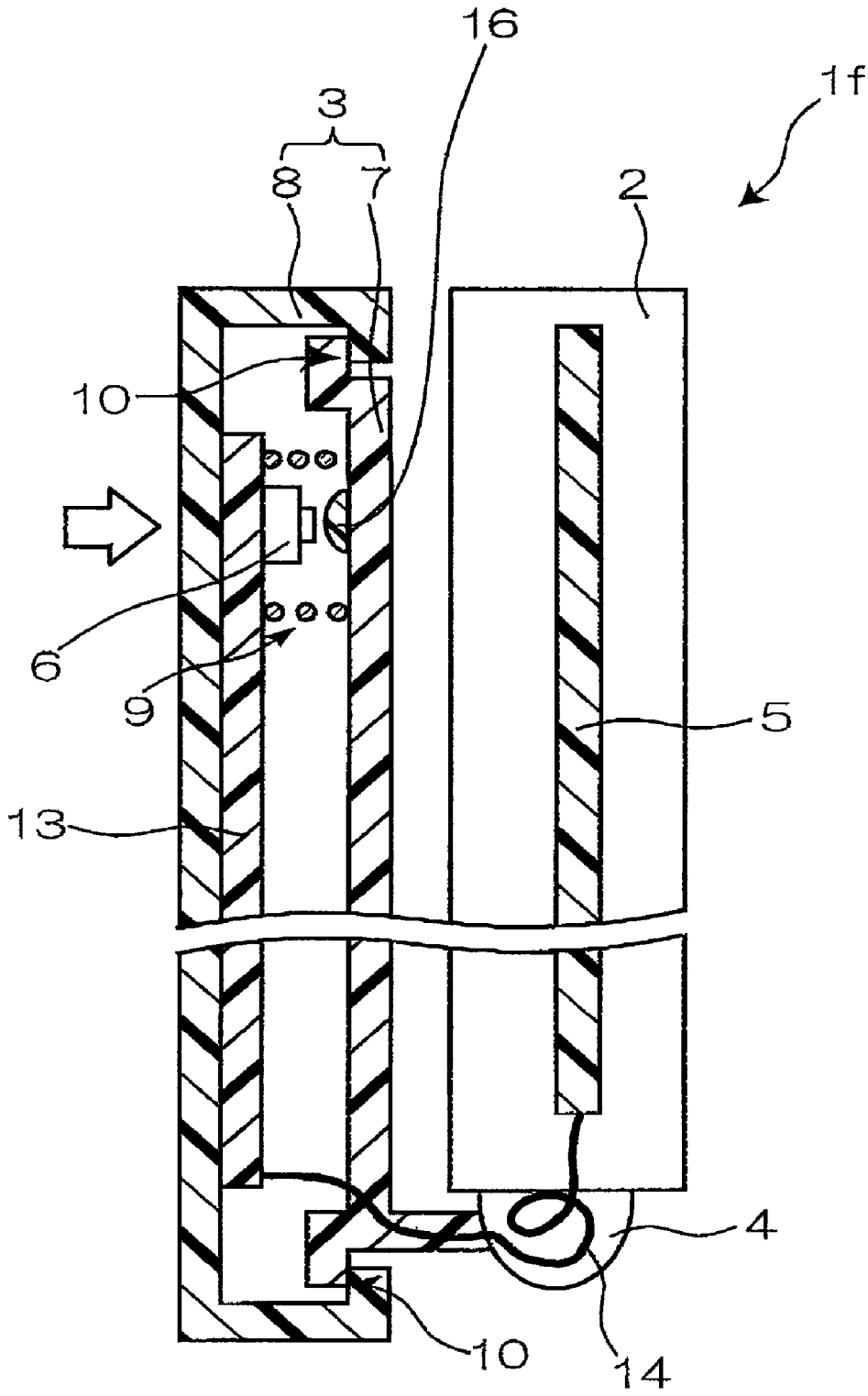
FIG. 7 is a sectional view illustrating a remote control apparatus according to a fifth embodiment of the invention.

FIG. 7 is a sectional view illustrating a remote control apparatus according to this embodiment.

As shown in FIG. 7, a remote control apparatus 1*f* according to this embodiment has opposite position of arrangement of the switch 6 to that of the remote control apparatus 1*d* according to the above-described fourth embodiment (see, FIG. 5). That is, in the remote control apparatus 1*f*, on a back surface of the upper panel 8 of the cover 3, a control substrate 13 is provided, and the switches 6 are provided on the back surface of the control substrate 13. Moreover, on the corresponding regions to switches 6 on the front surface of the lower panel 7, projections 16 are formed.

Thereby, when a user presses the portion provided with the switch 6 in the upper panel 8 to the remote control main body 12, the pressed portion on the upper panel 8 overcomes the biasing force of the bias means 9 and is displaced to the direction approaching the lower panel 7 so that the corresponding regulation means 10 is a support point. Thereby, the switch 6 positioned in the pressed portion contacts the projection 16 of the lower panel 7 and is pressed. The structures, operations, and effects except for the above-described ones in this embodiment are the same as the above-described second embodiment.

Next, a modified example of the fifth embodiment will be explained.

Figure 8:
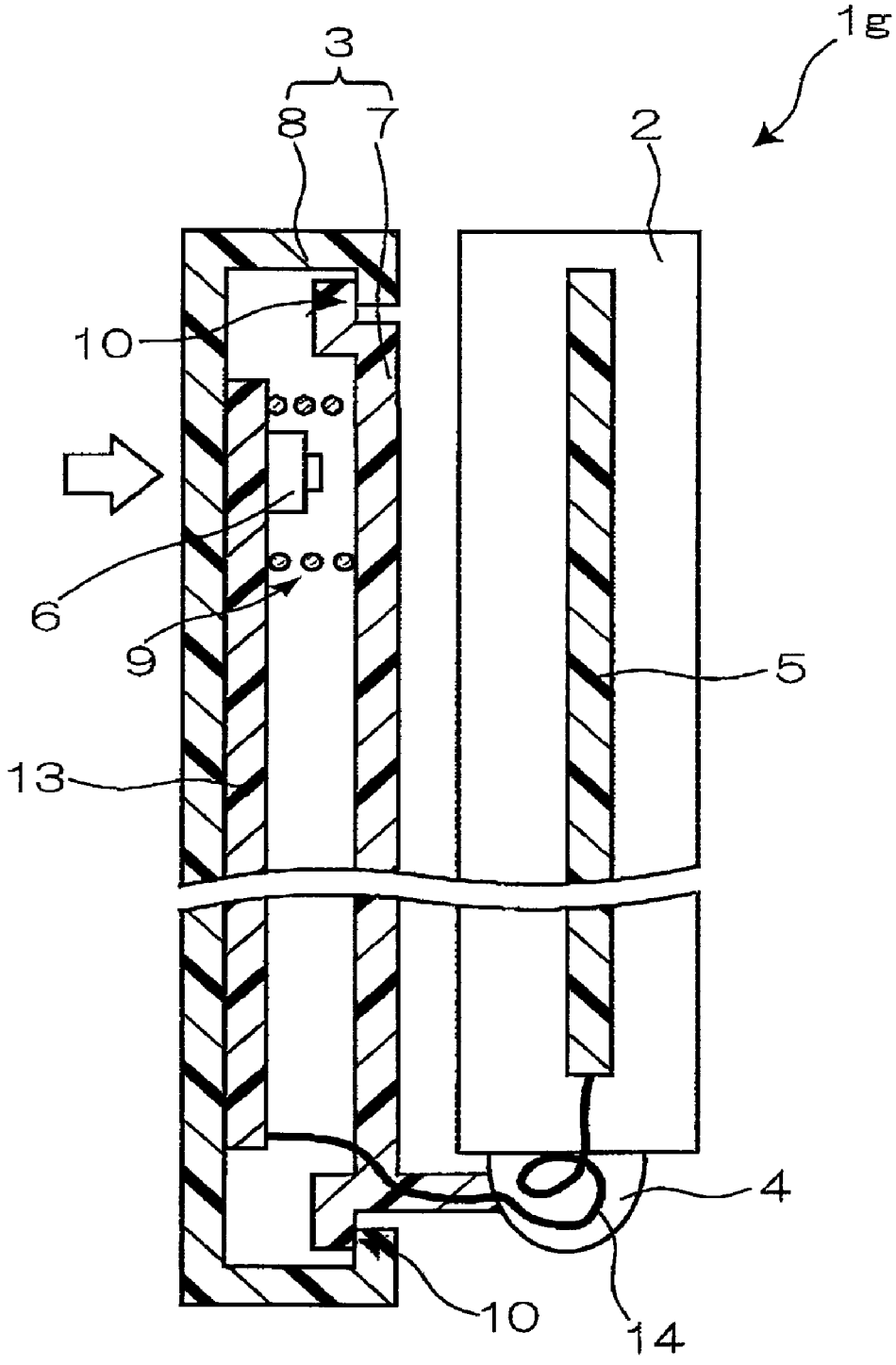
FIG. 8 is a sectional view illustrating a remote control apparatus according to a modified example of the fifth embodiment.

FIG. 8 is a sectional view illustrating a remote control apparatus according to this modified example.

As shown in FIG. 8, a remote control apparatus 1*g* according to this embodiment is different from the remote control apparatus 1*f* according to the above-described second embodiment (see, FIG. 7) in the point that the projection 16 (see FIG. 7) is not provided on the front surface of the lower panel 7. In this case, when the upper panel 8 is pressed, the portion contacting the switch 6 becomes a part of the lower panel 7. The structures, operations, and effects except for the above-described ones in this modified example are the same as the above-described fifth embodiment.

In the above-described first to fifth embodiments, it has been explained that the plurality of switches are displaced over a same surface. That is, there has been illustrated examples in which in the second embodiment, all of the switches 6 are disposed on the front surface of the remote control main body 2 (on the front surface of the control substrate 5), and in the third and fifth embodiments, all of the switches 6 are disposed over the back surface of the upper panel 8, and in the fourth embodiment, all of the switches 6 are disposed over the front surface of the lower panel 7. However, this invention is not limited thereto but one switch 6 may be disposed over one surface and another switch 6 may be disposed over the other surface. For example, it is possible that some switches 6 are disposed on the front surface of the remote control main body 2, and when the cover 3 is pressed, a part of the cover 3 contact each of the switches 6, and the other switches 6 are disposed on the back surface of the upper panel 8, and when the cover 3 is pressed, a part of the remote control main body 2 contacts each of the switches 6.

Next, a sixth embodiment of this invention will be explained.

Figure 9:
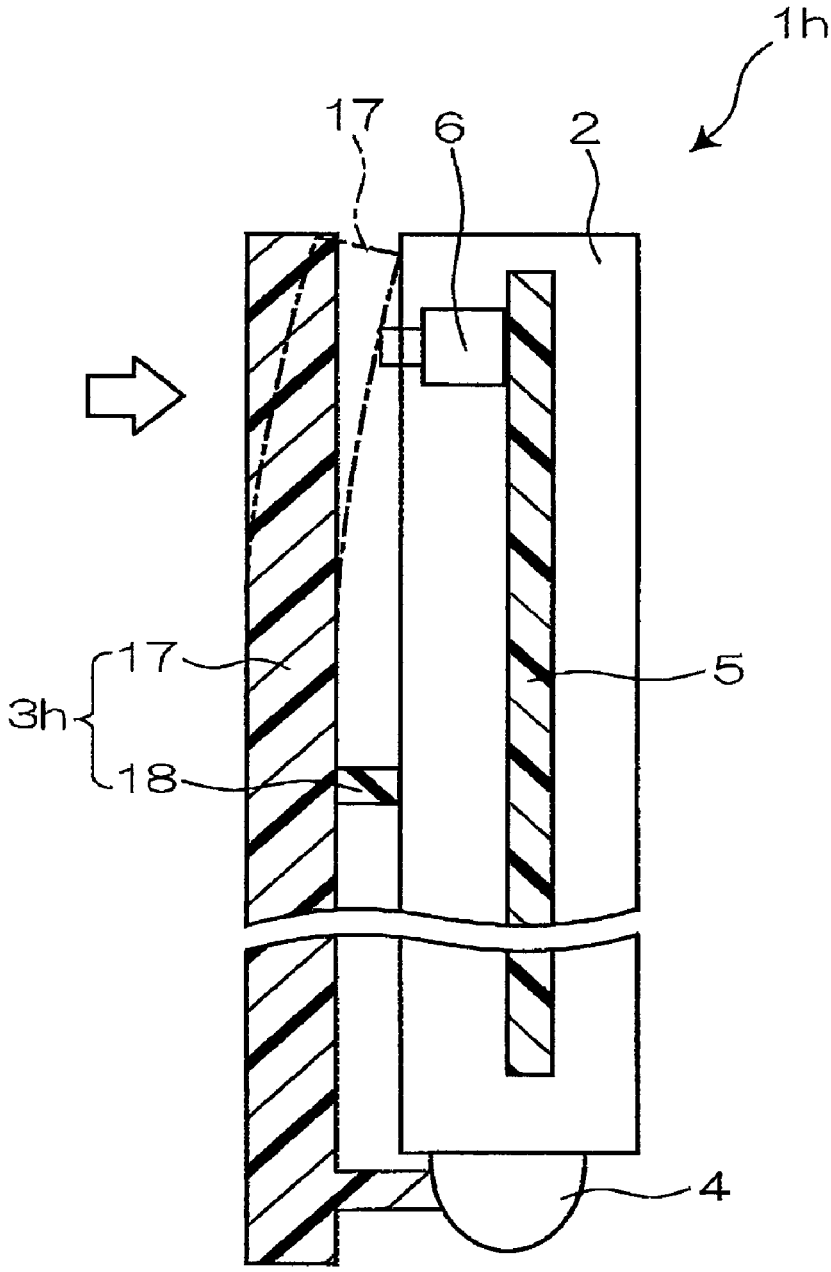
FIG. 9 is a sectional view illustrating a remote control apparatus according to a sixth embodiment of the invention.

FIG. 9 is a sectional view Illustrating a remote control apparatus according to this embodiment.

As shown in FIG. 9, a remote control apparatus 1*h* according to this embodiment has different structure of the cover from those of the remote control apparatus 1*a* according to the above-described second embodiment (see, FIG. 2). That is, in the remote control apparatus 1*h*, the remote control main body 2 and a cover 3*h* are provided. The cover 3*h* is formed mainly by one resin plate. In the cover 3*h*, for example, a resin plate 17 made of ABS resin (Acrylonitrile-Butadiene-Styrene copolymer resin) and having a thickness of 1.5 millimeter is provided, and a rib 18 made of the same resin is formed on the back surface of the resin plate 17. Moreover, in the remote control main body 2, the tip end of the switch 6 slightly projects from the front surface of the remote control main body 2. Viewed from the front, the rib 18 is disposed in the region among a plurality of the switches 6. The structures except for the above-described ones in the remote control apparatus 1*h* according to this embodiment are the same as the above-described second embodiment.

In this embodiment, when a user presses the portion corresponding to the switch 6 in the resin plate 17 to the rear namely to the direction facing to the remote control main body 2, the resin plate 17 is bended to the rear as shown by two-dot chain line in FIG. 9. In this case, the resin 17 bends so that the rib 18 contacting the front surface of the remote control main body 2 is a support point. And, the bended portion of the resin plate 17 contacts the switch 6 provided on the remote control main body 2 and presses the switch 6. Then, when the user detaches the hand from the resin plate 17, the resin plate 17 returns to be in the original shape by its elastic force and separates from the switch 6.

In this case, because the rib 18 is provided among the switches 6, the displacement of the resin plate 17 to the rear is locally regulated by the rib 18 and the resin plate 17 transforms so that the rib 18 is a support point. Thereby, the transformation region of the resin plate 17 is compartmented by the rib 18, and therefore, two or more switches 6 are not operated by pressing a part of the resin plate 17. Therefore, the user can select and push a plurality of switches 6 from above of the cover 3*h*.

According to this embodiment, compared to the above-described second embodiment, the structure of the cover can be simplified. The operations, and effects except for the above-described ones in this embodiment are the same as the above-described second embodiment.

In this embodiment, a projection may be formed in the region contacting the switch 6 in the back surface of the resin plate 17. Thereby, the switch 6 can be more certainly pressed by a small bend amount. In this case, the tip end of the switch 6 does not necessarily project from the front surface. Moreover, the rib 18 may be provided not on the back surface of the resin plate 17 but on the front surface of the remote control main body 2.

Hereinafter, specific examples for realizing the remote control apparatus according to these embodiments will be explained.

First, a first specific example will be explained. This first specific example is a specific example of the above-described second embodiment.

The remote control apparatus according to this specific example is an remote control apparatus for operating electronic hardware such as, a control apparatus for controlling drainage in the toilet bowl, a control apparatus for controlling opening and closing of the toilet lid, and a control apparatus for a heating apparatus of the toilet room (hereinafter, generically referred to as "sanitary cleansing apparatus or the like"), and is disposed to be fixed to the wall of the toilet room.

First, characteristics of the appearance of the remote control apparatus according to this specific example will be explained.

Figure 10:
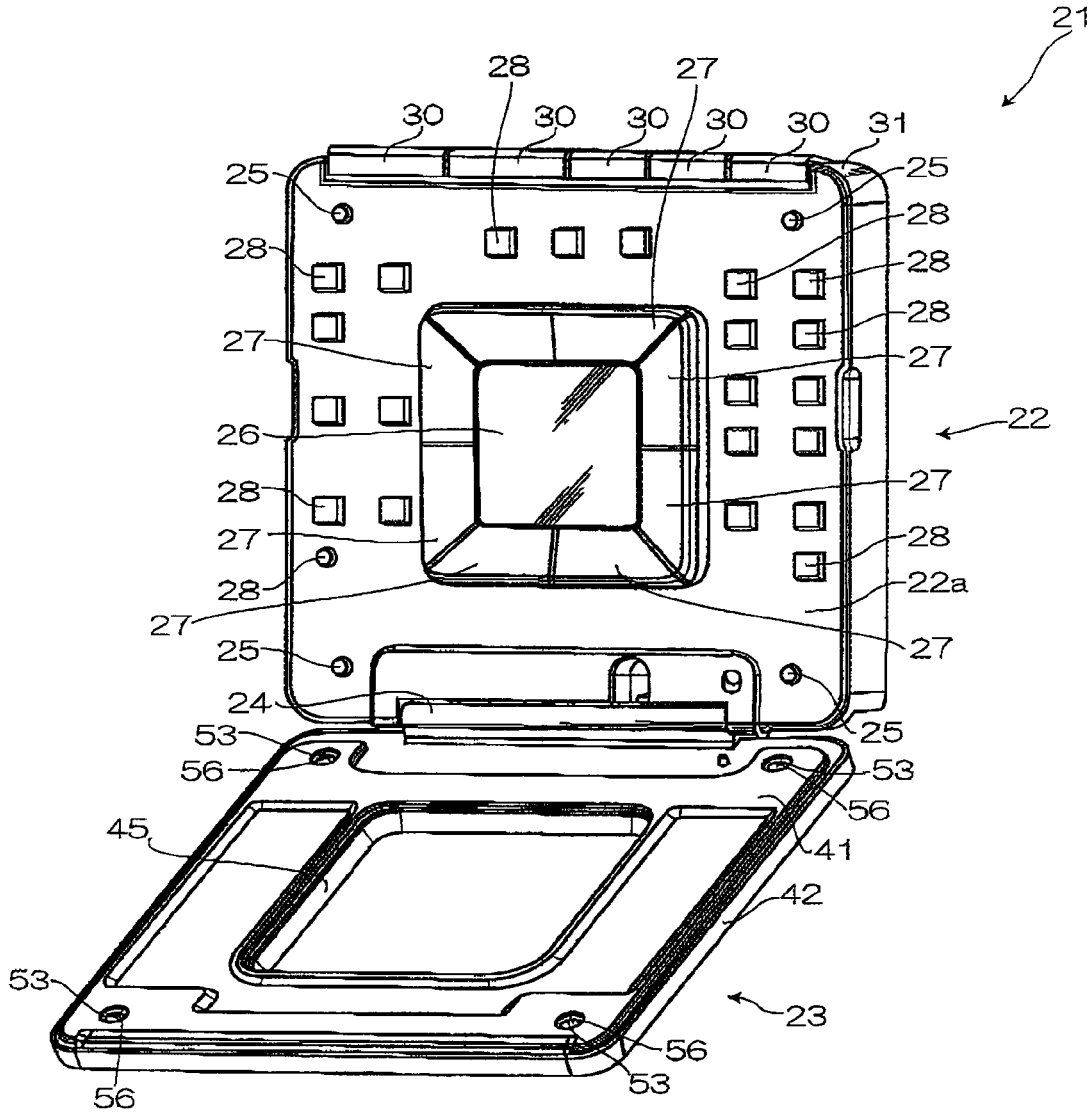
FIG. 10 is a perspective view illustrating a remote control apparatus according to a specific example of this embodiment.

FIG. 10 is a perspective view illustrating the remote control apparatus according to this specific example. FIG. 10 shows the opening state of the cover, and illustration of the surface sheet is omitted.

Figure 11:
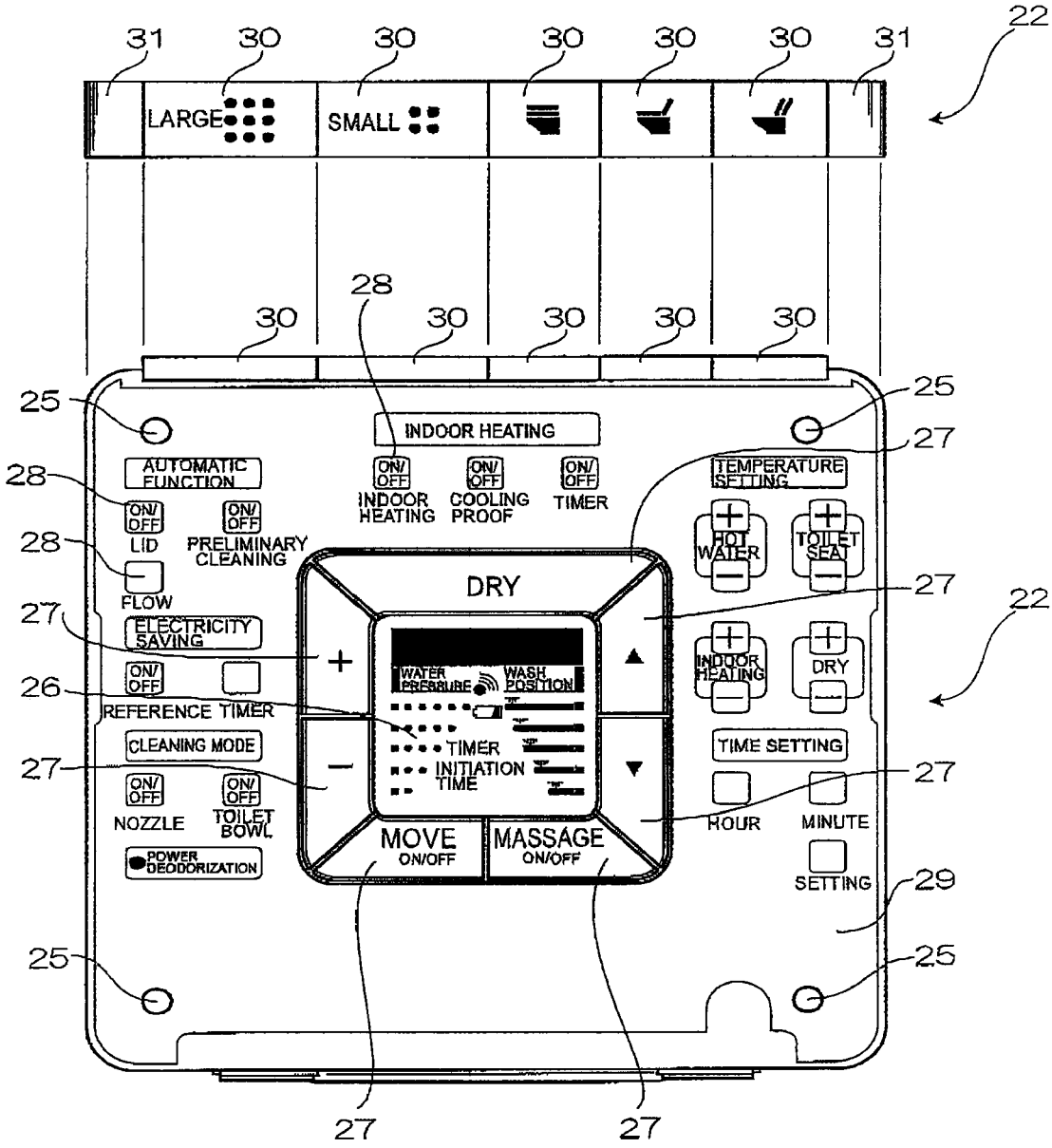
FIG. 11 is a front view and top view illustrating the remote control main body of the remote control apparatus according to this specific example.
Figure 12:
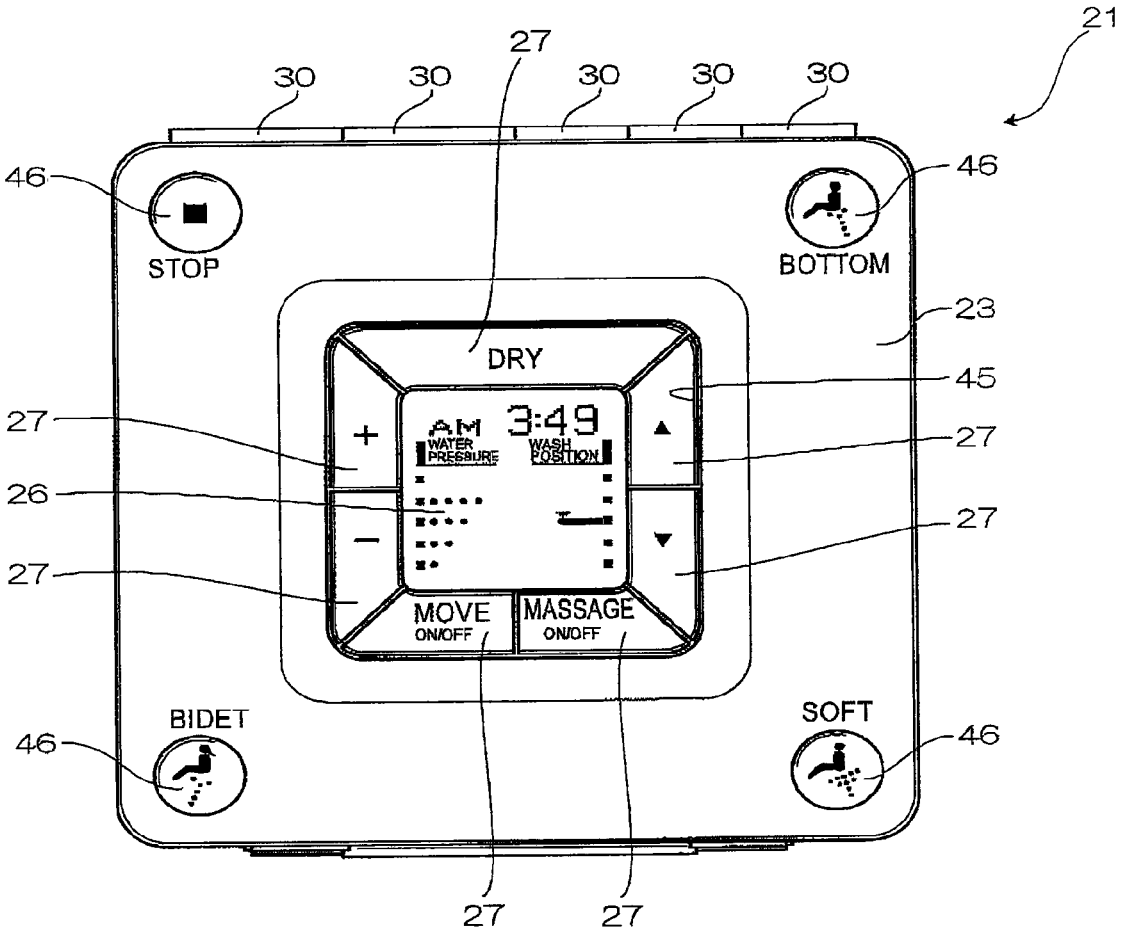
FIG. 12 is a plan view illustrating the remote control apparatus according to this specific example.
Figure 13:
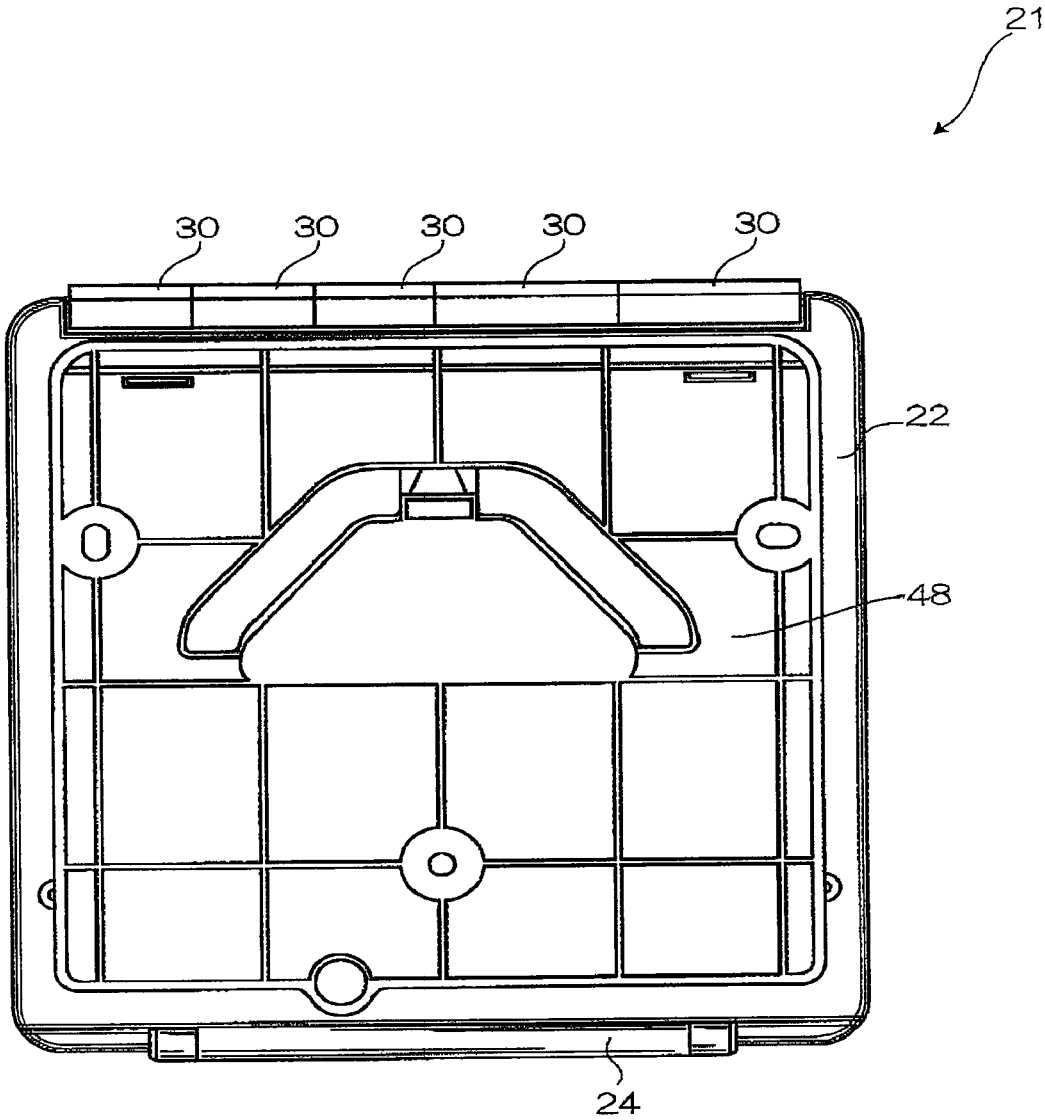
FIG. 13 is a back view Illustrating the remote control apparatus according to this specific example.

FIG. 11 is a front view and top view illustrating the remote control main body of the remote control apparatus according to this specific example, and FIG. 12 is a plan view illustrating the remote control apparatus according to this specific example, and shows the closed state of the cover, and FIG. 13 is a back view illustrating the remote control apparatus according to this specific example.

As shown in FIG. 10, in the remote control apparatus 21 according to this specific example, a remote control main body 22 and a cover 23 are provided. Viewed from the perpendicular direction to the wall surface (not shown) provided with the remote control apparatus 21, for example, the profile of the remote control main body 22 and the profile of the cover 23 are approximately matched, and both thereof are, for example, a square whose corners are rolled. And, one end of the cover 23 is connected rotatably to a lower portion of the remote control main body 22 through a hinge 24. Thereby, the cover 23 is rotatable in the range of about 180° so that the hinge 24 is the rotational center. As a result, the cover 23 covers the front surface of the remote control main body 22 in the upper position and exposes the front surface of the remote control main body 22 in the lower position.

As shown in FIGS. 10 and 11, in each of the four corners of the front surface of the remote control main body 22, a switch 25 is provided. The switch 25 is a switch operated with being pressed. To the switches 25, operations of high operation frequency such as operations of initiation and stop of discharge of bottom cleansing water out of the operations of the sanitary cleansing apparatus are assigned. Moreover, in the central portion of the front surface of the remote control main body 22, a display portion 26 is provided. The display portion 26 displays at least a part of operation contents of the sanitary cleansing apparatus or the like and information of current time or a battery remaining amount or the like, and is brightened when any one switch of the switches 25, switches 27 and switches 28 to be described later is pushed.

Furthermore, around the display portion 26 in the front surface of the remote control main body 22, a plurality of switches 27 are provided so as to surround the display portion 26. The switch 27 is a switch operated with being pressed. For example, seven switches 27 are provided, and one switch is disposed above the display portion 26, and two switches are each disposed on the left, right, and lower sides thereof. The front surface of the switch 27 is sloped to the front surface of the remote control main body 22, and its outer circumferential side, namely, the end edge of the far side from the display portion 26 is located in front more than its inner circumferential side, namely, the end edge of the display portion 26. And, the end of the inner circumferential side of each of the switches 27 rides an end of a protective plate 26*d* (see FIG. 14) of the display portion 26, and the front surface of the switch 27 makes approximately continuous surface with the front surface of the display portion 26. On the other hand, the end edge of the outer circumferential side of each of the switches 27 is located in front more than the front surface of the remote control main body 22. Therefore, the switch 27 projects in front more than the other regions in the front surface of the remote control main body 22.

To the switch 27, for example, operations of higher operation frequency next to the operations assigned to the switches 25 are assigned out of the operations of the sanitary cleansing apparatus. For example, two switches 27 disposed in the left side of the display portion 26 are for controlling pressure of the bottom cleansing water, and the letter "+" is noted on the front surface of the upper-side switch 27 out of the two switches 27, and the letter "–" is noted on the front surface of the lower-side switch 27. Moreover, the two switches 27 disposed in the right side of the display portion 26 is for controlling a discharge position of the bottom cleansing water, and the sign "▲" is noted on the front surface of the upper-side switch 27 out of the two switches 27, and the sign "▼" is noted on the front surface of the lower-side switch 27. When the pressure and position of the bottom cleansing water are controlled by operating the switches 27, the letters "WATER PRESSURE" and drawings showing the pressure of the bottom cleansing water are displayed in the left region of the display portion 26, and the letters "WASH POSITION" and drawings showing the discharge position of the bottom cleansing water are displayed in the right region of the display portion 26. Thereby, a user operates the contiguous switches 27 to the display with looking at the display of the display portion 26, and thereby, can easily control the pressure and the discharge position of the bottom cleansing water.

Furthermore, the one switch disposed in the upper side of the display portion 26 is for operating dry function of the sanitary cleansing apparatus, namely, function of spraying a warm air to local area of the user, and the letters "DRY" are noted on the front surface of the switch 27. Furthermore, the two switches 27 disposed in the lower side of the display portion 26 are for operating the move function and massage function of the sanitary cleansing apparatus respectively, and the letters "MOVE ON/OFF" and "MASSAGE ON/OFF" are noted on the front surfaces of the switches 27, respectively.

Furthermore, around the region in which the display portion 26 and the switches 27 are disposed in the front surface of the remote control main body 22, a plurality of switches 28 are provided. The switches 28 are also switches operated with being pressed. To the switches 28, operations of relatively low operation frequency are assigned. For example, to the switches 28, operations of, operation of indoor heading function, mode setting of the sanitary cleansing apparatus, time setting, and temperature settings of the bottom cleansing water and the dry warm air and the toilet bowl and the indoor heating, are assigned. In this region, a soft surface sheet 29 is provided and the switches 28 are arranged so as to approach from the holes provided in the surface sheet 29.

Furthermore, on the upper surface of the remote control main body 22 that is not covered with the cover 23, switches for operations of high operation frequency operated by a user in the standing state such as switches 30 for operating the electronic hardware for controlling drainage in the toilet bowl and opening and closing of the toilet lid and so forth are provided. For example, five switches 30 are provided, and on the upper surfaces of the respective switches 30, the letters "LARGE" and figure that indicate drainage for stool, the letters "SMALL" and figure that indicate drainage for urine, a figure indicating that both of the toilet seat and the toilet lid are closed, a figure indicating that the toilet seat is closed and that the toilet lid is opened, and a figure indicating that both of the toilet seat and the toilet lid are opened, are noted sequentially from the left. The switches 30 are disposed so as to approach from the cutout provided in the upper surface side of the surface sheet 29. Thereby, width of the anteroposterior direction of the switches can be equal to width of the anteroposterior direction of the remote control main body 22, and therefore, the width of the switches 30 can be enlarged to the maximum. As a result, the operation areas of the switches 30 become wide and the operability is improved.

Furthermore, at both ends of right and left of the upper surface of the remote control main body 22, transmission portions 31 for transmitting control signals representing the operation contents to the sanitary cleansing apparatus or the like are provided. The transmission portion 31 outgoes, for example, infrared. In the sanitary cleansing apparatus or the like, a receiving portion for receiving the infrared is provided.

On the other hand, the cover 23 is composed so that a lower panel 41 disposed in the remote control main body 22 side when the cover 23 is closed and an upper panel 42 disposed in the opposite side of the remote control main body 22 are superposed. The hinge 24 is connected to the lower panel 41, and therefore, when the cover 23 is closed, the lower panel 41 is fixed to the remote control main body 22 and the upper panel 42 is supported by the lower panel 41.

As shown in FIG. 12, the cover 23 forms one opening portion 45 exposing the display portion 26 and the switches 27 of the remote control main body 22 when the cover 23 is closed. Viewed from front, the opening portion 45 is disposed in the central portion of the cover 23 and its shape is, for example, square. The opening portion 45 is composed by opening portions formed in the lower panel 41 and the upper panel 42 of the cover 23 respectively. Thereby, when the cover 23 is closed, the display portion 26 and the switches 27 are disposed in the opening portion 45 and exposed to the outside through the opening portion 45.

The height of the front surface of the cover 23 is approximately equal to the height of the end edge of the far side from the display portion 26. On the other hand, as described above, the end of the inner circumferential side of the switch 27, namely, the display portion 26 side rides the end of the display portion 26 and composes approximately continuous surface with the front surface of the display portion 26. Therefore, the front surface of the cover 23, the front surface of the switches 27, and the front surface of the display portion 26 compose approximately continuous surface. Thereby, when the cover 23 is closed, the front surface of the remote control apparatus 21 becomes approximately continuous surface in whole.

Moreover, at the corners in the front surface of the cover 23 that are regions corresponding to the front of the switches 25 of the remote control main body 22 when the cover 23 is closed, patelliform concave portions 46 are formed. On each of the concave portions 46, a note representing the corresponding operation content of the switch 25 is printed. For example, on the concave portion 46 of the upper left side, the sign "■" representing discharge stop of the bottom cleansing water is printed and the letters "STOP" are printed in the vicinity thereof. Moreover, on the concave portion 46 of the upper right side, a figure representing general discharge initiation of the bottom cleansing water is printed and the letters "BOTTOM" are printed in the vicinity thereof. Furthermore, on the concave portion 46 of the lower right side, a figure representing discharge initiation of foam-like bottom cleansing water is printed and the letters "SOFT" are printed in the vicinity thereof. Furthermore, on the concave portion 46 of the lower left side, a figure representing discharge initiation of bidet water is printed and the letters "BIDET" are printed in the vicinity thereof.

For distinguishing each of the press regions of the cover 23, a convex portion may be formed instead of the concave portion 46, or a concave and convex portion may be formed. Moreover, the concave portion, the convex portion, or the concave and convex portion may be formed on a part of the press region of the cover 23 or may be formed on the whole press region.

On the other hand, as shown in FIG. 13, in a back surface plate 47 (see FIG. 47) of the remote control main body 22, a hanger 48 for attaching the remote control main body 22 to the wall surface is provided.

Next, the characteristics of the inner structure of the remote control apparatus according to this specific example will be explained.

Figure 14:
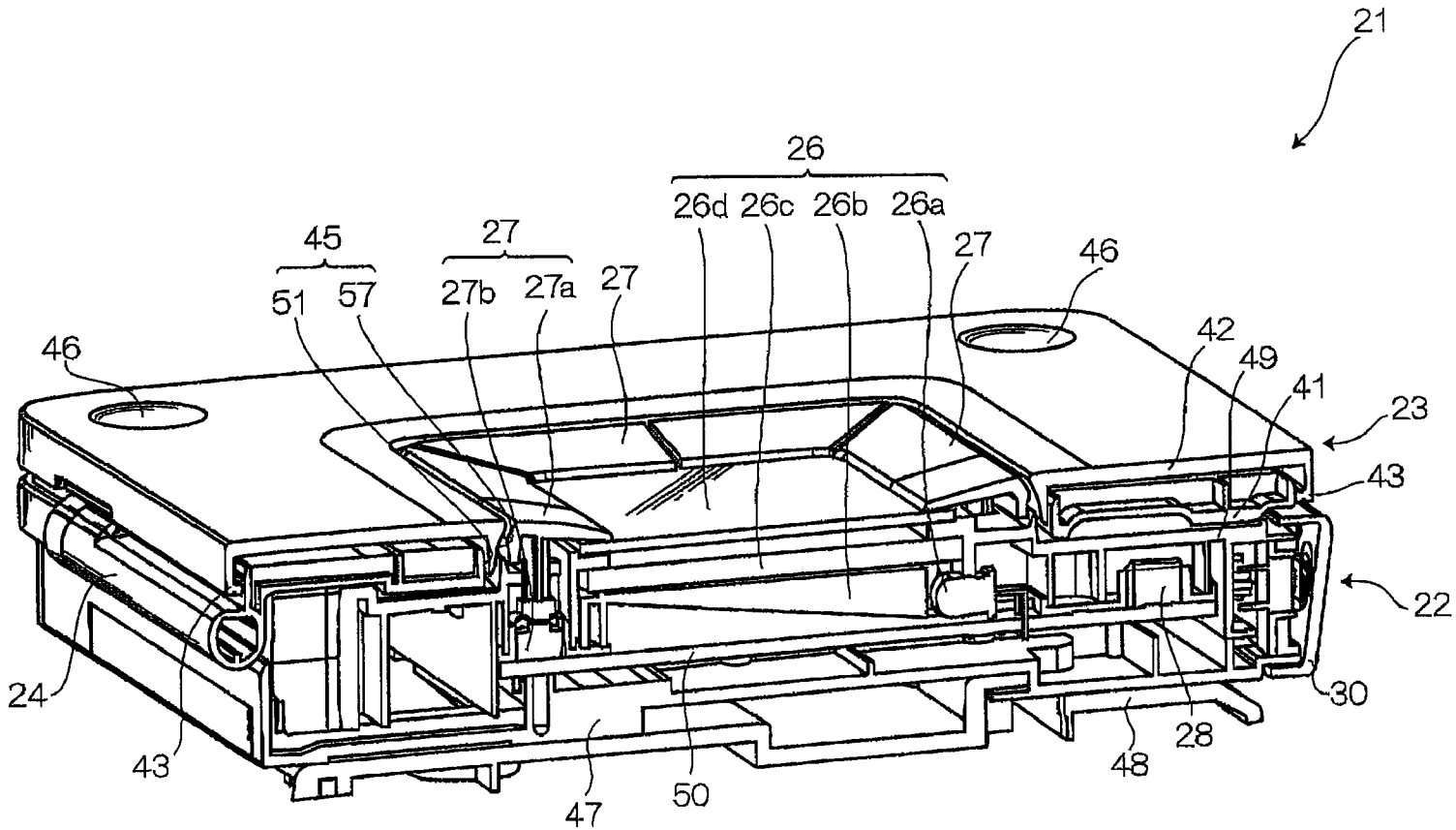
FIG. 14 is a sectional perspective view parallel to both of the vertical direction and anteroposterior direction illustrating the remote control apparatus according to this specific example.

FIGS. 14 to 26 are views illustrating an inner structure of the remote control apparatus according to this specific example. That is, FIG. 14 is a sectional perspective view parallel to both of the vertical direction and anteroposterior direction illustrating the remote control apparatus according to this specific example. In the FIG. 14, illustration of the surface sheet is omitted.

Figure 15:
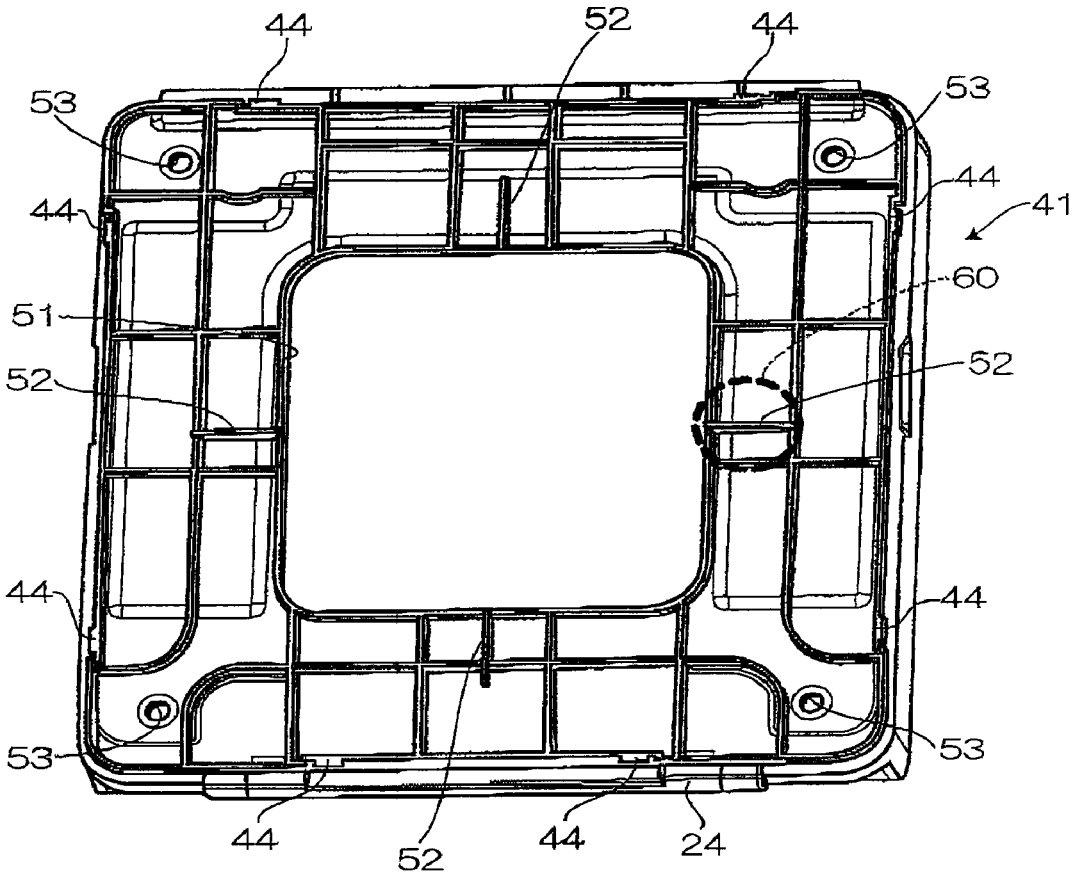
FIG. 15 is a perspective view illustrating a lower panel of the remote control apparatus according to this specific example.
Figure 16:
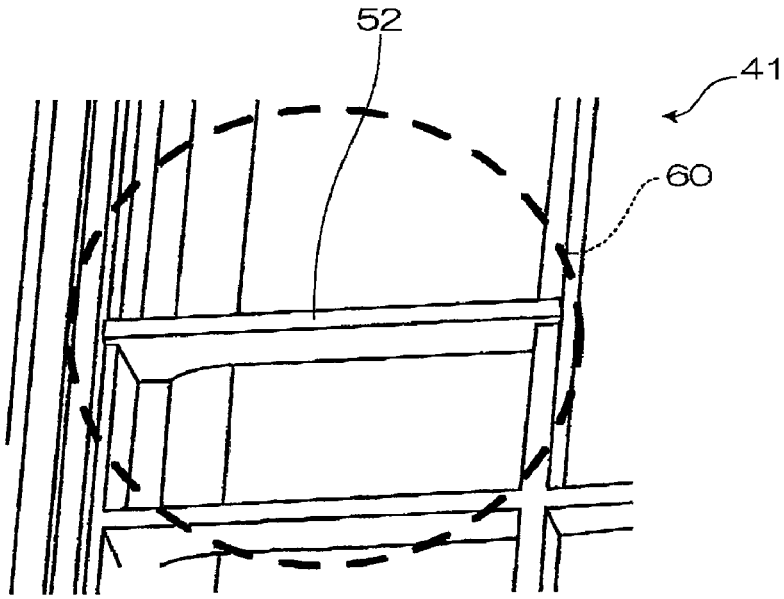
FIG. 16 is a partially enlarged perspective view illustrating a rib formed in the lower panel.

Moreover, FIG. 15 is a perspective view illustrating a lower panel of the remote control apparatus according to this specific example, and FIG. 16 is a partially enlarged perspective view illustrating a rib formed in the lower panel.

Figure 17:
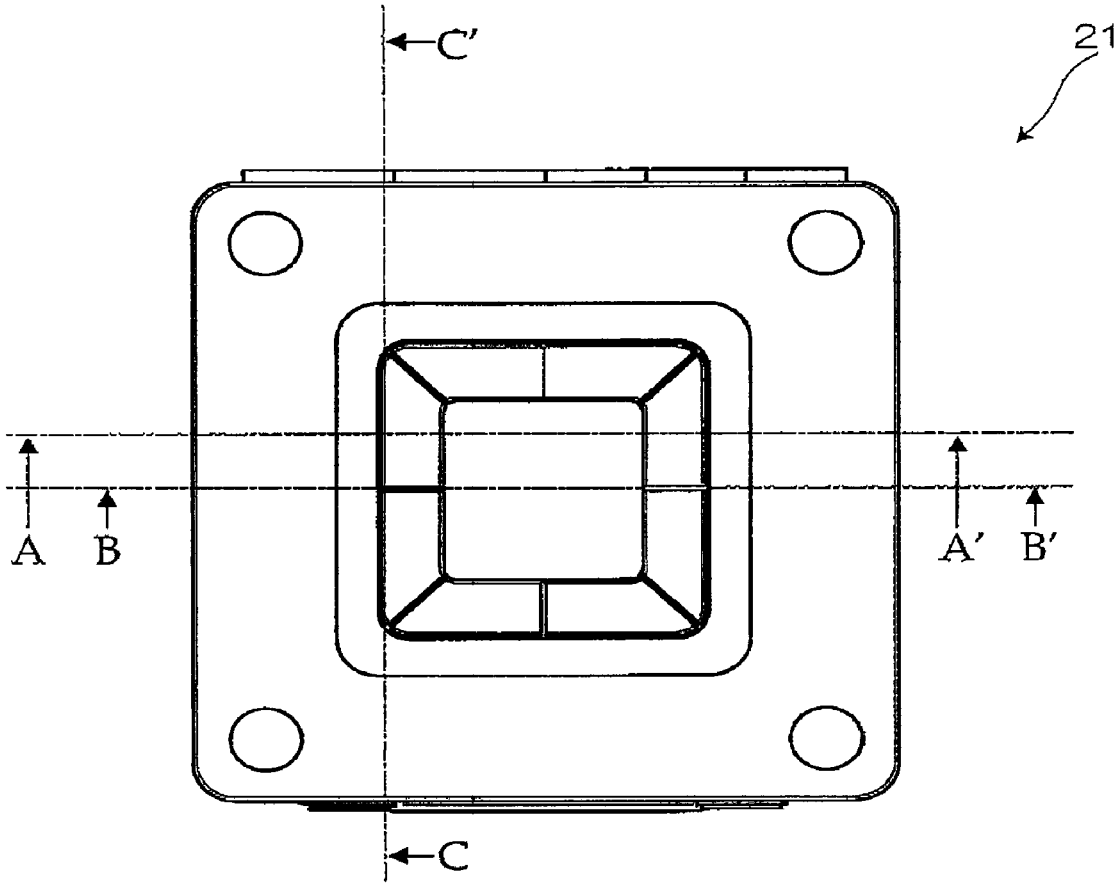
FIG. 17 is a plan view Illustrating the remote control apparatus according to this specific example.
Figure 18A:
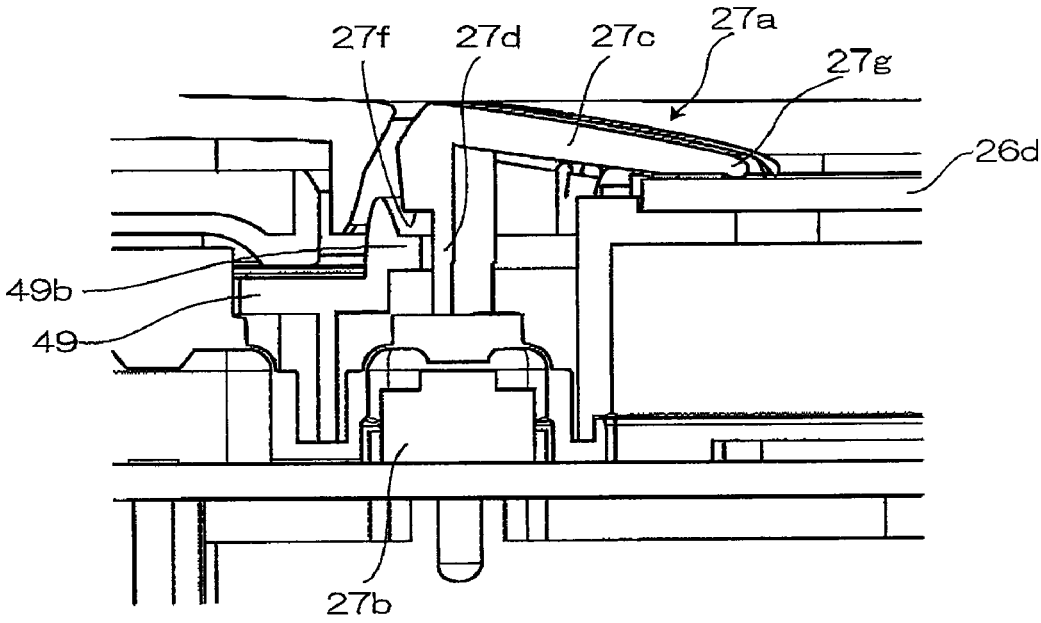
FIGS. 18A and 18B are a sectional view and a sectional perspective view according to A-A' line shown In FIG. 17, respectively.
Figure 18B:
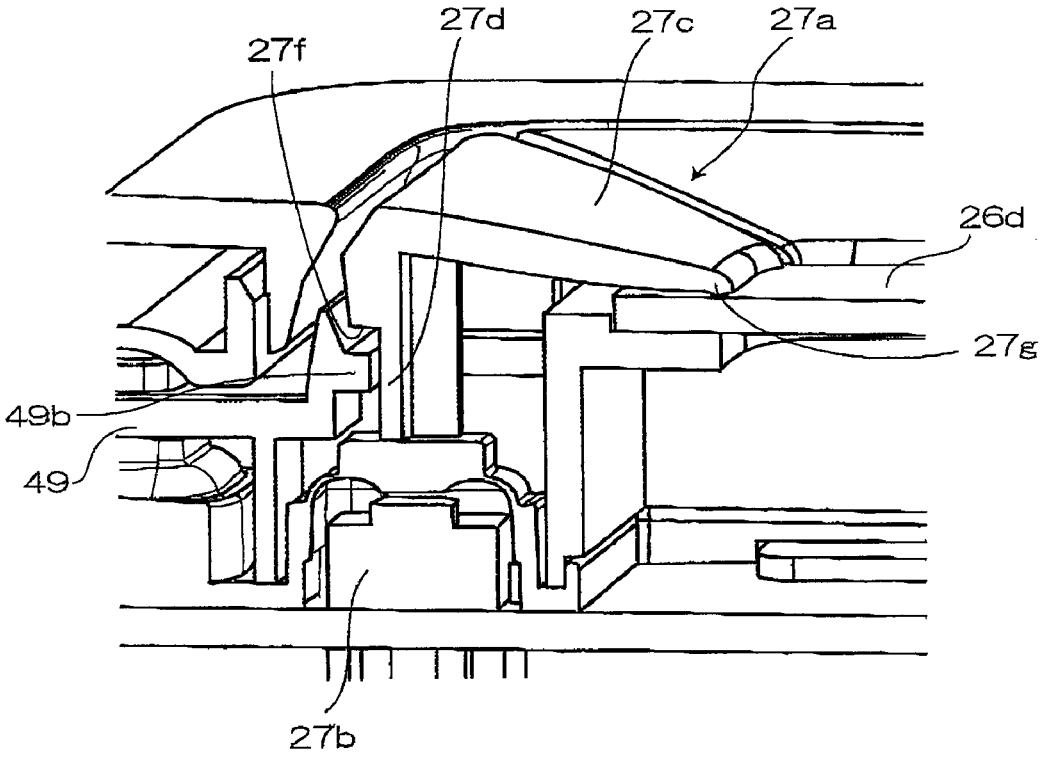
Figure 19A:
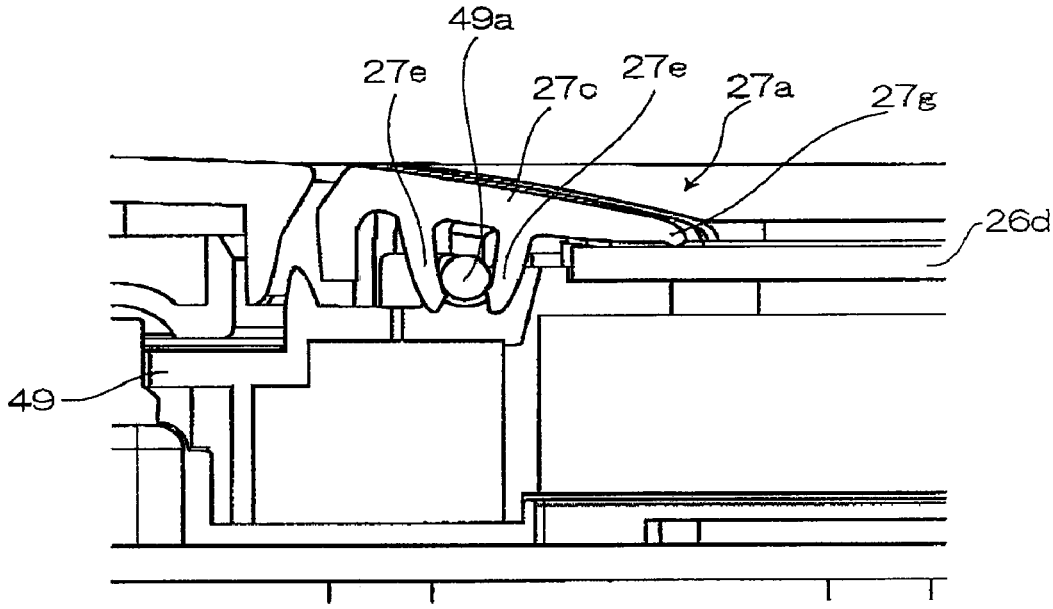
FIGS. 19A and 19B are a sectional view and a sectional perspective view according to B-B' line shown In FIG. 17, respectively.
Figure 19B:
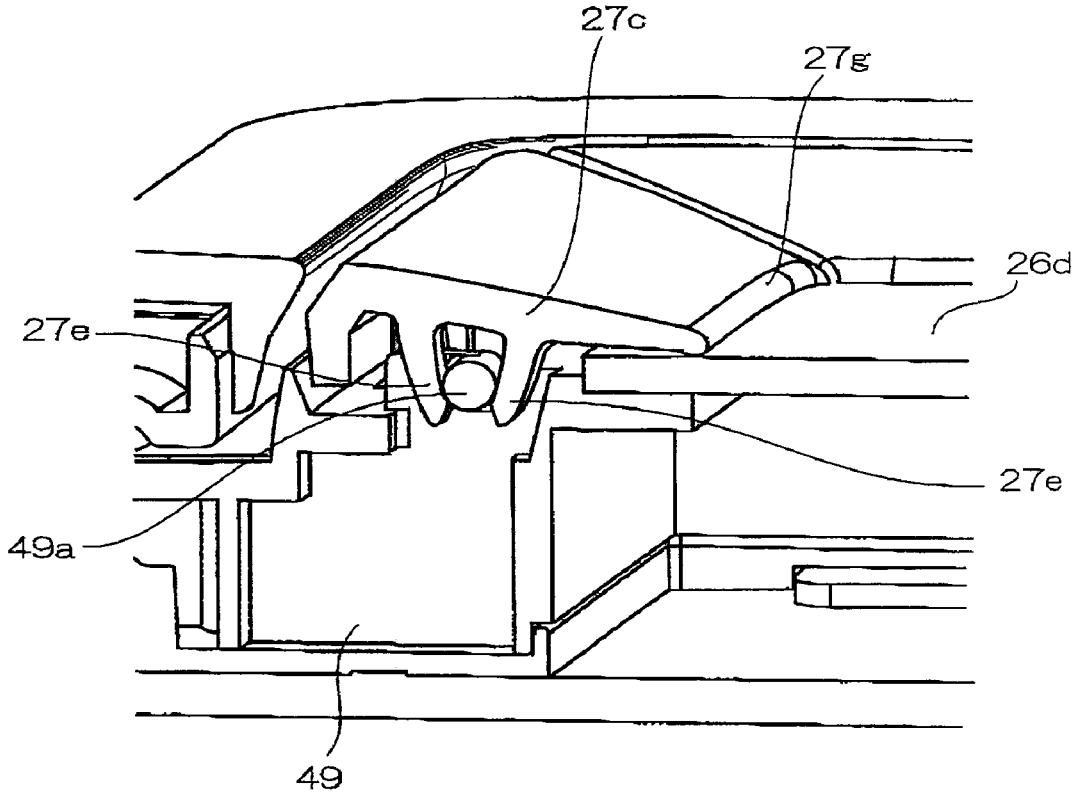
Figure 20A:
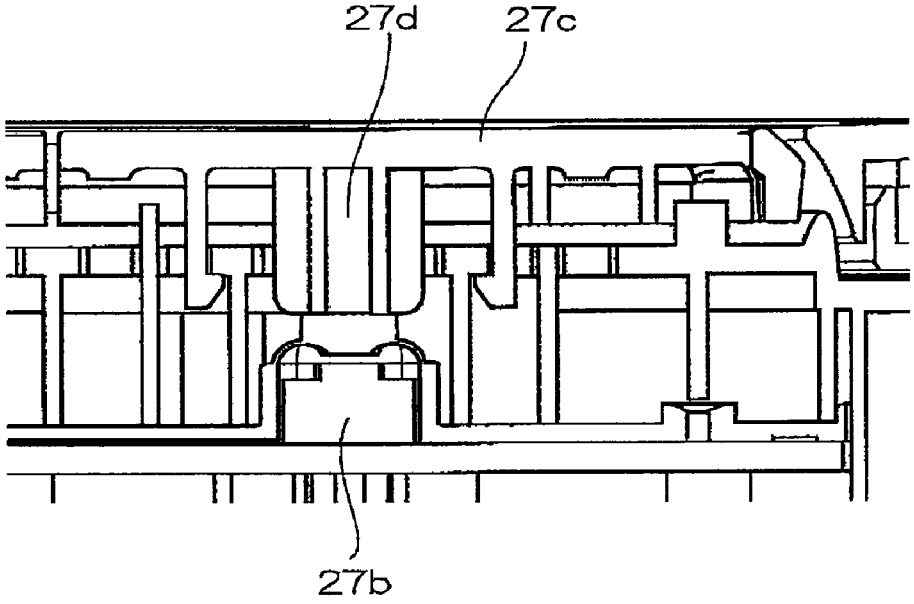
FIGS. 20A and 20B are a sectional view and a sectional perspective view according to C-C' line shown in FIG. 17, respectively
Figure 20B:
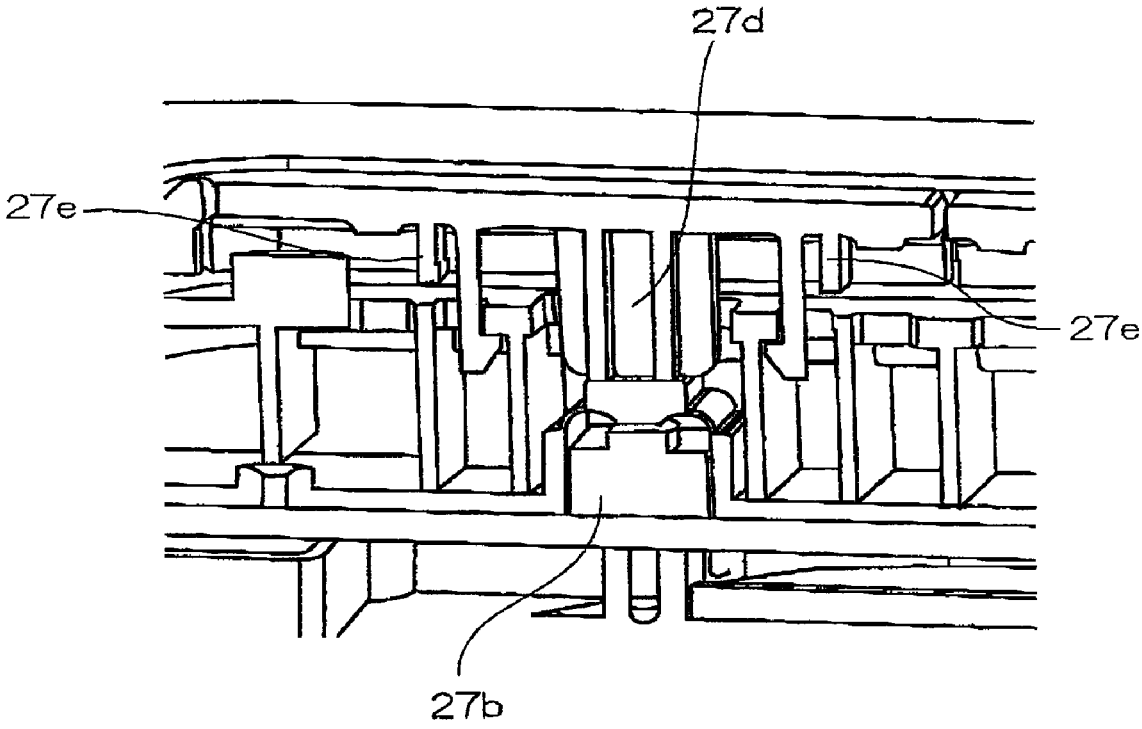

Furthermore, FIG. 17 is a plan view illustrating the remote control apparatus according to this specific example, and FIGS. 18A and 18B are a sectional view and a sectional perspective view according to A-A' line shown in FIG. 17, respectively, and FIGS. 19A and 19B are a sectional view and a sectional perspective view according to B-B' line shown in FIG. 17, respectively, and FIGS. 20A and 20B are a sectional view and a sectional perspective view according to C-C' line shown in FIG. 17, respectively.

Figure 21:
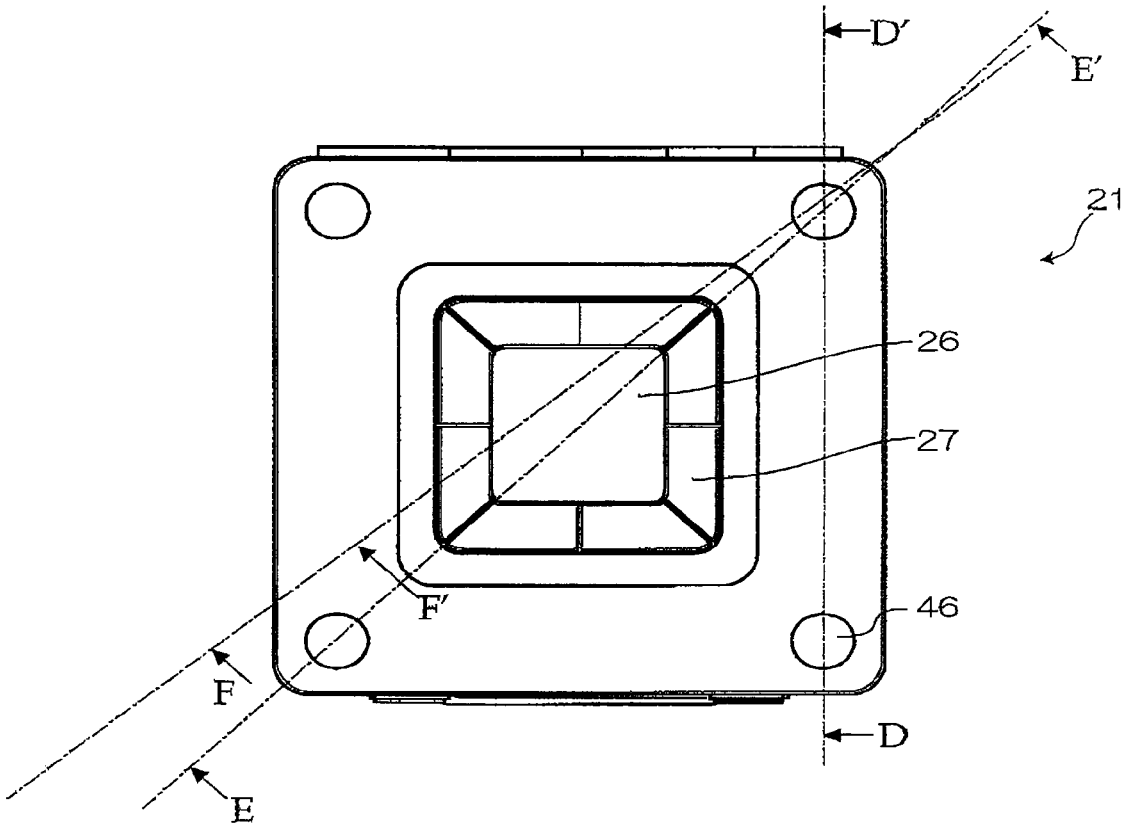
FIG. 21 is a plan view illustrating the remote control apparatus according to this specific example.
Figure 22:
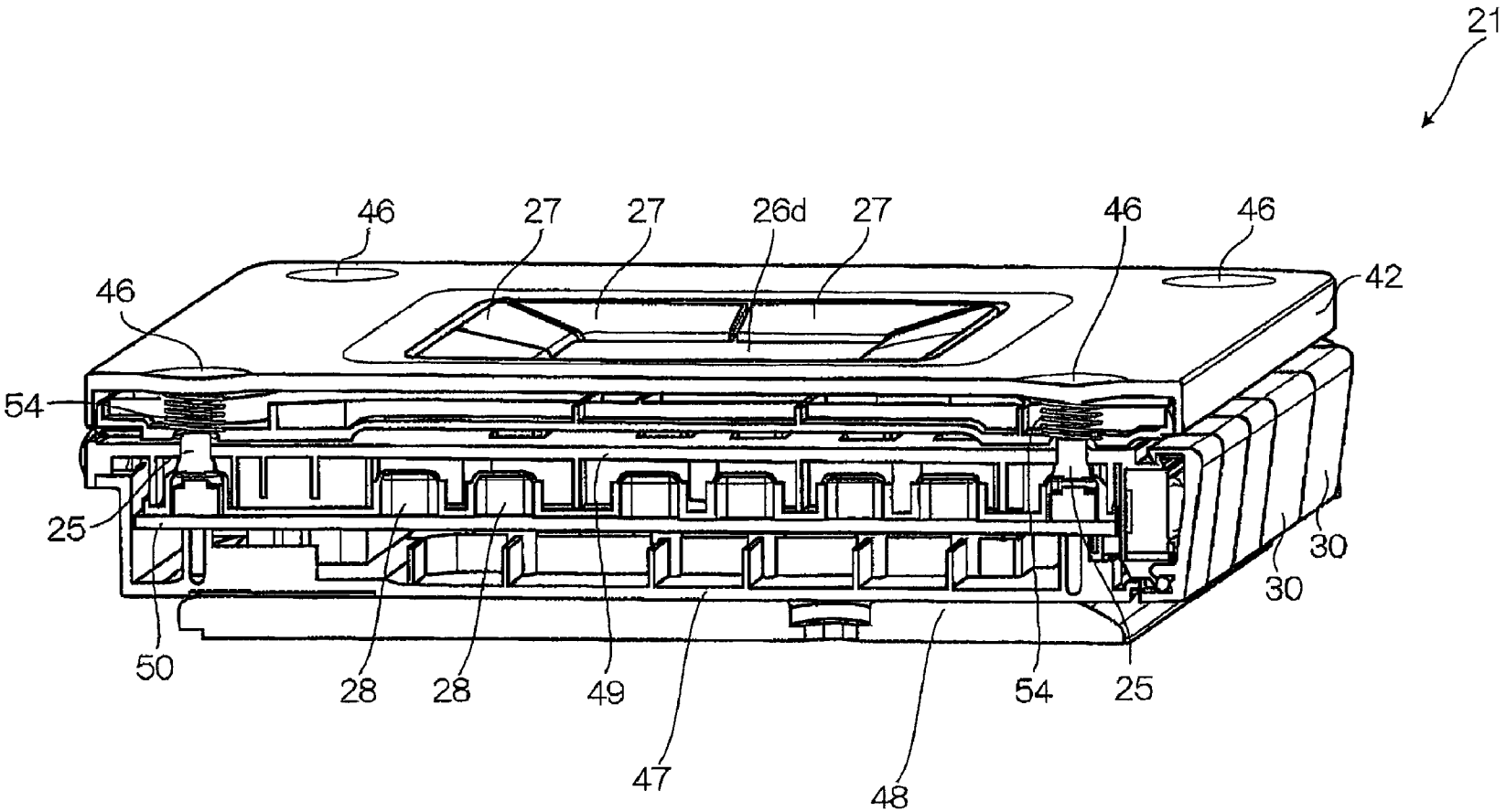
FIG. 22 is a sectional perspective view according to D-D' line shown in FIG. 21.
Figure 23:
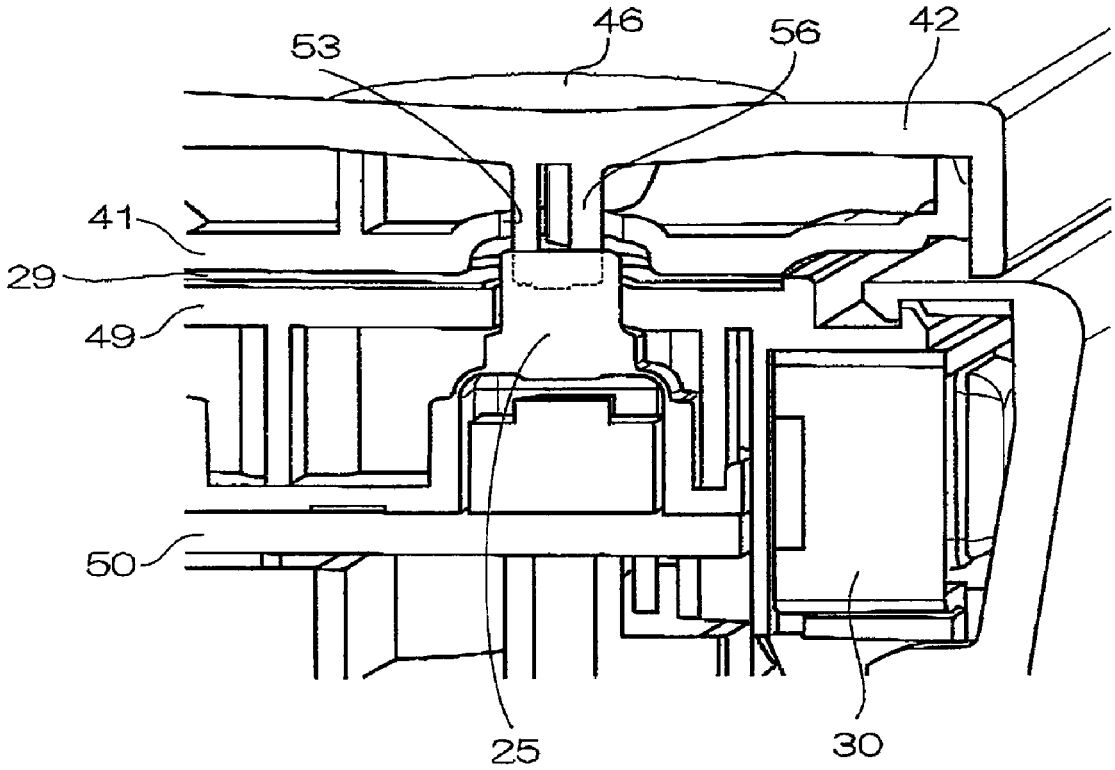
FIG. 23 is a partially enlarged sectional perspective view according to D-D' line shown in FIG. 21.
Figure 24:
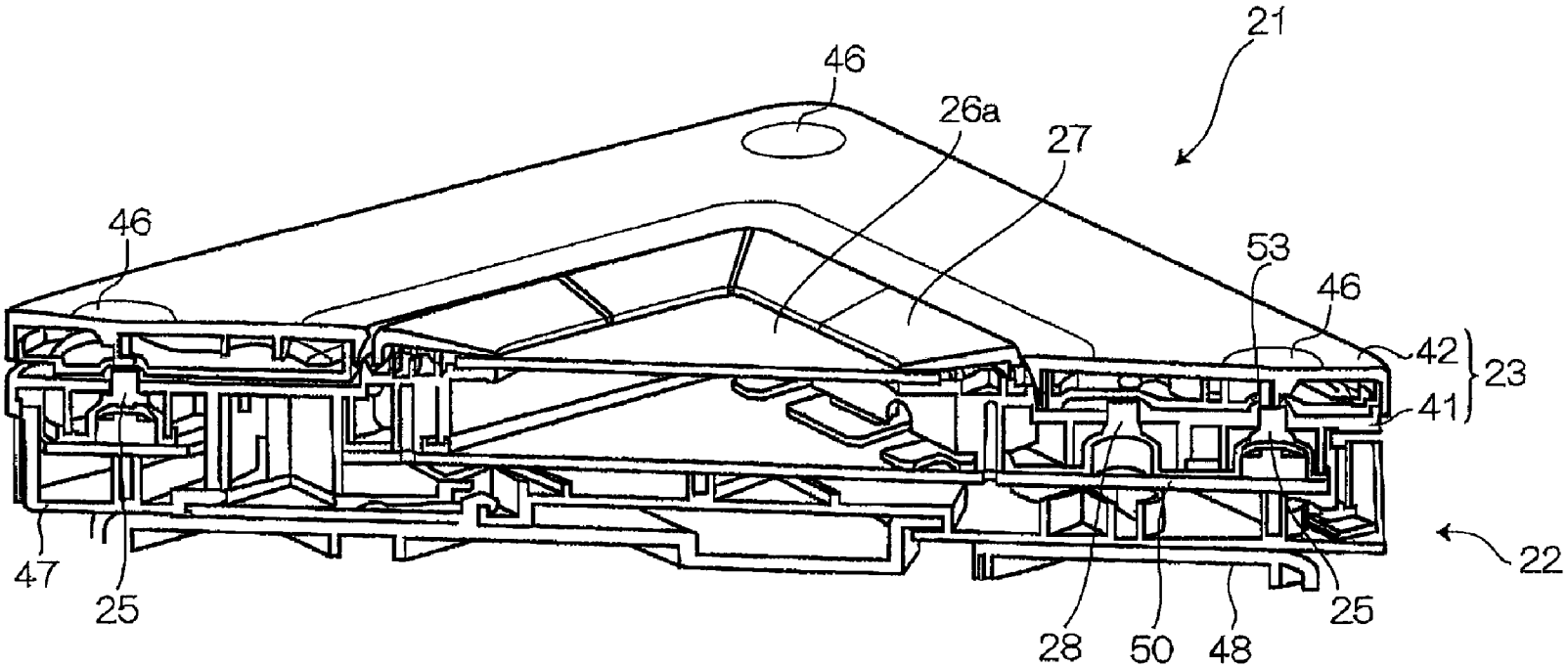
FIG. 24 is a sectional perspective view according to E-E' line shown in FIG. 21.
Figure 25:
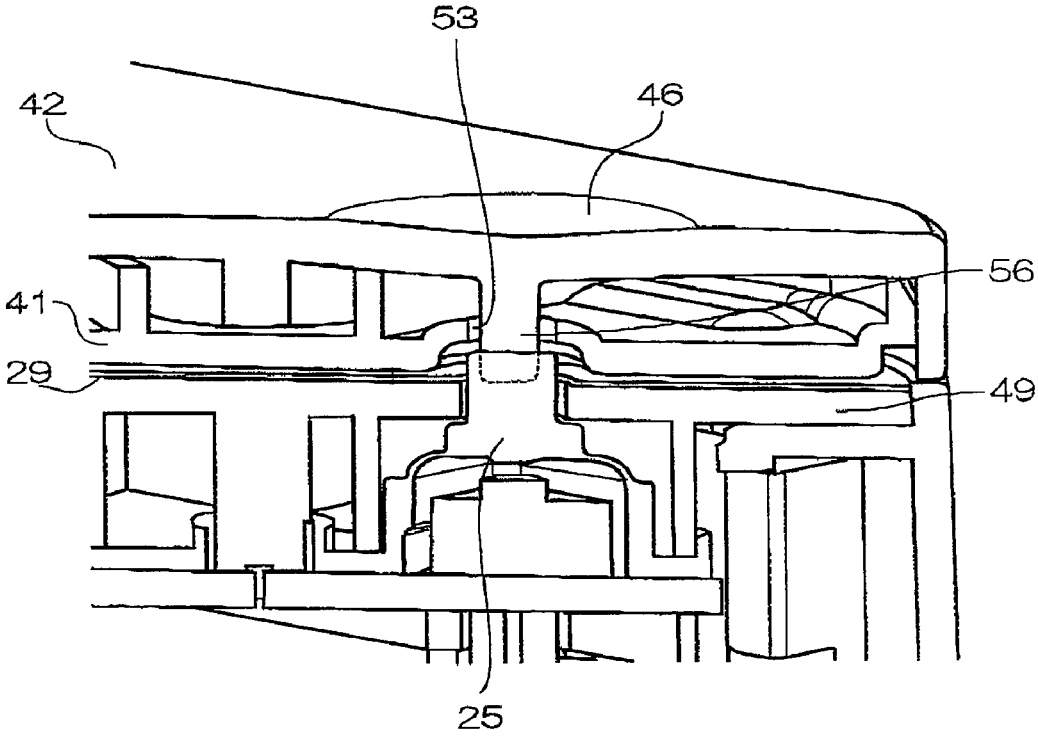
FIG. 25 is a partially enlarged sectional perspective view according to E-E' line shown in FIG. 21.
Figure 26:
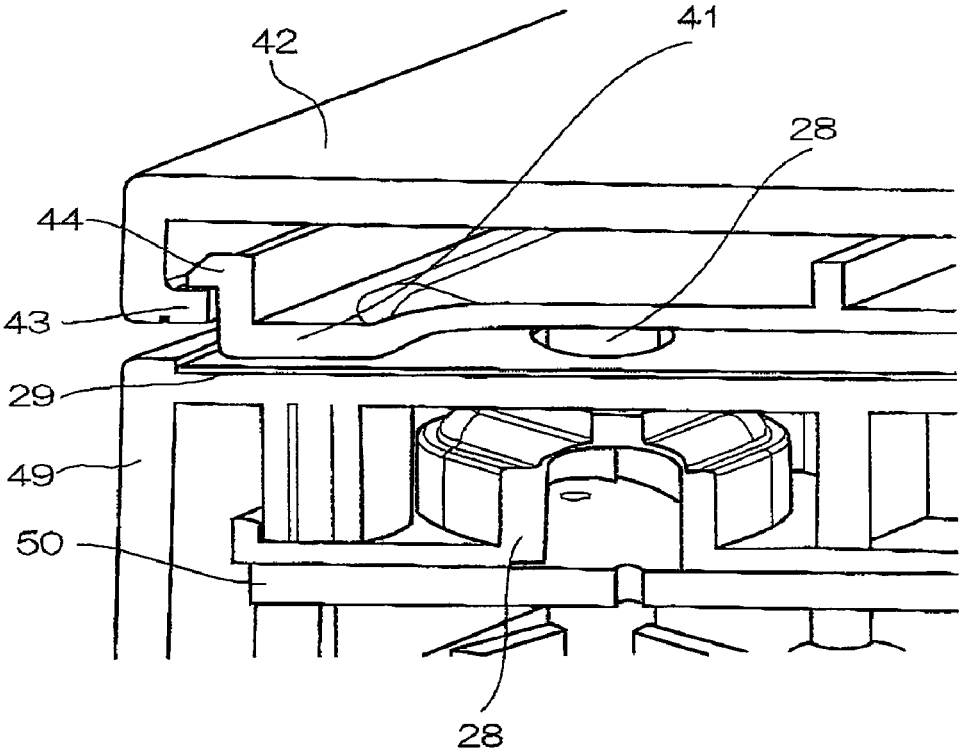
FIG. 26 is a partially enlarged sectional perspective view according to F-F' line shown in FIG. 21.

Furthermore, FIG. 21 is a plan view illustrating the remote control apparatus according to this specific example, and FIG. 22 is a sectional perspective view according to D-D' line shown in FIG. 21, and FIG. 23 is a partially enlarged sectional perspective view according to D-D' line shown in FIG. 21, and FIG. 24 is a sectional perspective view according to E-E' line shown in FIG. 21, and FIG. 25 is a partially enlarged sectional perspective view according to E-E' line shown in FIG. 21, and FIG. 26 is a partially enlarged sectional perspective view according to F-F' line shown in FIG. 21.

As shown in FIG. 14, in the remote control main body 22, on the front surface of the back surface plate 47, a support counter 50 doubling with the control substrate is provided, and in front of this support counter 50, a top plate 49 composing the front surface of the remote control main body 22 is provided. And by the support counter 50 and the top plate 49, each of the parts composing the switches 25, 27, and 28, the display portion 26, and so forth is supported.

In the display portion 26, LED (Light Emitting Diode) 26*a* is provided as the light source, and a light guide plate 26*b* is provided at the position that the output light of the LED 26*a* reaches. The light guide plate 26*b* is to output the light input from the side surface thereof, in a uniform sheet form from the front surface thereof. In front of the light guide plate 26*b*, a crystal display panel 26*c* is provided, and in front of the crystal display panel 26*c*, a protection plate 26*d* is provided. Thereby, the light output from the LED 26*a* inputs the side surface of the light guide plate 26*b* and outputs in a sheet form to front from the front surface of the light guide plate 26*b* and passes through the crystal display panel 26*c*, and thereby, the image is added, and the light transmits through the protection plate 26*d*, and outputs to front from the display 26.

Moreover, as shown in FIG. 14 and FIGS. 17 to 20, in the switch 27, a key top 27*a* exposed to the front surface of the remote control main body 22 and a contact portion 27*b* disposed in the rear of the key top 27*a* and attached to the support counter 50 of the remote control main body 22 are provided. In the key top 27*a*, a front surface plate 27*c* composing the front surface of the switch 27, a pressing portion 27*d* extending to the rear from the central portion of the width direction of the outer circumferential side of the front surface plate 27*c*, and two pairs of locking portions 27*e* extending to the rear from both end portions of the width direction of the outer circumferential side of the front surface plate 27*c*, are integrally formed. The distal portion (posterior side part) of the pressing portion 27 is thinner than the proximal portion (anterior side part), and thereby, a step 27*f* is formed on the surface of the outer circumferential side of the pressing portion 27*d*. Moreover, an end 27*g* of the inner circumferential side of the front surface plate 27*c* rides the front surface of the protection plate 26*d* of the display portion 26. Furthermore, the anterior portion of the outer circumferential surface of the key top 27*a* bends to the display portion 26 side toward front.

On the other hand, in the top plate 49, a columnar extending portion 49*a* extending to the axial direction of the switch 27 so as to be located between the locking portions 27*e* of each of the pairs thereof and a jutting portion 49*b* with which the step 27*f* engages when the key top 27*a* is pushed down are provided.

Thereby, the key top 27*a* is guided by the locking portion 27*e* engaging with the extending portion 49*a* of the top plate 49, and thereby, is rotatable in the anteroposterior direction so that the end 27*g* of the inner circumferential side of the front surface plate 27*c* is the rotational axis.

And, the locking portion 27*e* is locked by the extending portion 49*a*, and thereby, the end of the anterior side of the move region of the key top 27*a* is prescribed, and the step 27*f* contacts the jutting portion 49*b*, and thereby, the end of the posterior side of the move region of the key top 27*a* is prescribed.

As shown in FIG. 14, viewed from front, the profile of the upper panel 42 is one size larger than the profile of the lower panel 41, and both-side end edges and both-end vicinities in the upper end edge of the upper panel 42 are folded once to the rear and then folded to the inside, and thereby, become a U-shaped portion 43. Eight U-shaped portions 43 are formed in the entire upper panel 42. The U-shaped portion 43 enrolls an engaging portion 44 (see FIG. 15) formed in the end of the lower panel 41 and thereby functions as a regulation means for regulating the movement of the upper panel 42 to the separating direction from the lower panel 41.

FIG. 16 is a view enlarging and showing a region 60 shown in FIG. 15. As shown in FIGS. 15 and 16, in the central portion of the lower panel 41, an opening portion 51 composing the opening portion 45 of the cover 23 is formed. Moreover, in the near region to the opening portion 51 that is in the center of each of sides in the surface of the upper panel 42 side of the lower panel 41, a rib 52 extending from the center to the periphery of the lower panel 41 is provided. That is, in the surface of the upper panel 42 side of the lower panel 41, four ribs 52 are disposed radially. The ribs 52 regulate the movement of the upper panel 42 to the direction toward the lower panel 41. In this specific example, the ribs 52 are provided in the lower panel but may be provided in the upper panel. Furthermore, in four corners of the lower panel 41, holes 53 are formed. Furthermore, at the portion engaging with the U-shaped portion 43 of the upper panel 42 in the end of the lower panel 42, the engaging portion 44 is provided.

As shown in FIGS. 21 and 22, the lower panel 41 is provided with a spring 54 as a bias means for biasing the upper panel 42 to the separating direction from the lower panel 41. And, the spring 54 biases the upper panel 42 to the separating direction from the lower panel 41, and the above-described U-shaped portion 43 (see FIG. 26) engages with the engaging portion 44 (see FIG. 26) to regulate the movement of the upper panel 42 to the separating direction from the lower panel 41, and thereby, the position of the upper panel 42 to the lower panel 41 is maintained to be constant, for example, the upper panel 42 is held to be in parallel to the lower panel 41.

Moreover, as shown In FIG. 14, in the central portion of the upper panel 42, an opening portion 57 is formed. By the opening portion 57 and the opening portion 51 of the lower panel 41, the opening portion 45 of the cover 23 is composed. Furthermore, as shown in FIGS. 23 to 25, in the four corner of the upper panel 42, projecting portions 56 projecting to the rear are formed. Each of the projecting portions 56 is inserted through the hole 53 of the lower panel 41 and disposed in the position matched to the switch 25 of the remote control main body 22 when the cover 23 is closed. The projection portion 56 is disposed in the position inserted through the spring 54.

Furthermore, for example, as shown in FIGS. 18 and 19, the front portion of the side surface of the opening portion 57 of the upper panel 42 bends to the display portion 26 side toward front. Thereby, the side surface of the opening portion 57 juts along the outer circumferential surface of the key top 27*a* so as to cover the outer circumferential surface, and an approximately uniform gap is formed between the side surface of the opening portion 57 and the outer circumferential surface of the key top 27*a*. The size of the gap is designed to be as small as possible in the range that the cover 23 and the key top 27*a* are not contacted, considering operation traces of the upper panel 42 and the key top 27*a*.

Next, operation of the remote control apparatus 21 according to this specific example will be explained.

The remote control apparatus 21 is generally used in the closed state of the cover 23. In this case, the display portion 26 and the switches 27 provided in the central portion of the remote control main body 22 are exposed to the outside through the opening portion 45 of the cover 23, and the portion except therefor in the front surface of the remote control main body 22 is covered with the cover 23. Therefore, the switches 25 and 28 are in the state of not being seen with hidden by the cover 23. Moreover, the switch 30 disposed in the upper surface of the remote control main body 22 is exposed in the upper surface of the remote control apparatus 21. And, a user can operate switches 25, switches 27 and switches 30 in the closed state of the cover 23 and can view the display portion 26. On the other hand, the user opens the cover 23 and thereby can operate the switches 28. Also in this case, the display portion 26 can be viewed and the switches 27, 28, and 30 can be operated.

Next, operation in operating the switches 25 will be explained.

When the user does not touch the cover 23, the spring 54 in the lower panel 41 of the cover 23 biases the upper panel 42 toward front, and on the other hand, the U-shaped portion 43 of the upper panel 42 engages with the engaging portion 44 of the lower panel 41 to regulate movement of the upper panel 42 toward front. Thereby, the upper panel 42 is held, for example, to be in parallel to the lower panel 41. In this case, the projecting portion 56 of the upper panel 42 is inserted through the hole 53 of the lower panel 41 but does not press the switch 25.

In this state, when the user presses the concave portion 46 or its surrounding region formed in a corner of the upper panel 42 of the cover 23, the corner of the upper panel 42 overcomes the biasing force of the spring 54 and approaches the lower panel 41, and the upper panel 42 is sloped to the lower panel 41. Therefore, the projecting portion 56 located in the rear of the pressed concave portion 46 presses the switch 25 disposed in the rear through the hole 53 of the lower panel 41. As a result, the switch 25 is operated. In this case, the projecting portions 56 disposed in the corners except for the pressed corner do not press the corresponding switches 25. Therefore, the user can operate the switches 25 in the closed state of the cover 23. And, when the user detaches the hand from the concave portion 46, the position of the upper panel 42 returns to be in the original state by the biasing force of the spring 54 and the switch 25 comes back to be in the original state.

On the other hand, when the user presses a central vicinity of each of the sides of the cover 23, the upper panel 42 contacts the rib 52 of the lower panel 41, and thereby, the movement of the upper panel 42 to the rear is regulated. Therefore, any one of the switches 25 is not pressed. Thereby, when the user presses a central vicinity of each of the sides of the cover 23, such a mistake operation as operating the two switches 25 sandwiching the side can be prevented.

As described above, because the user can treat the wide site around the corner as the region being capable of operating the switch 25, the press region making the switch operation possible becomes drastically large and the operability of the remote control apparatus is improved.

Hereinafter, the operation difference between the case of pressing the corner (concave portion 46) of the cover 23 and the case of pressing the side will be explained quantitatively with reference to a numeric value example.

Figure 27:
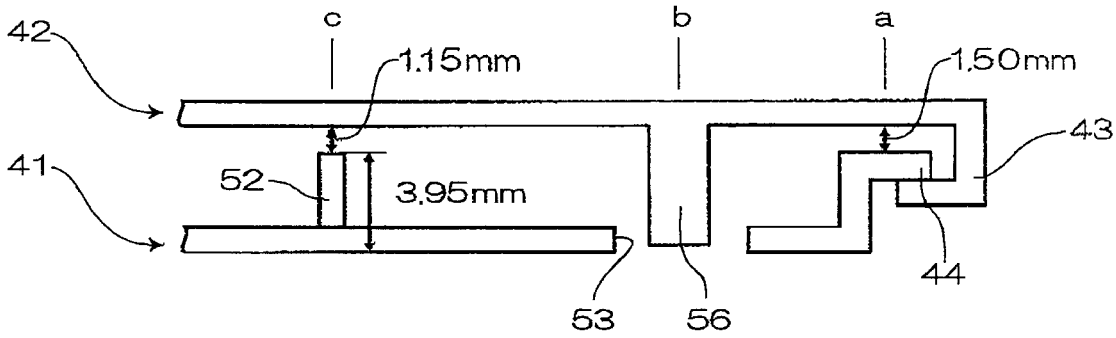
FIG. 27 is a view schematically illustrating sizes of the respective portions in the remote control apparatus according to this specific example.

FIG. 27 is a view schematically illustrating sizes of the respective portions in the remote control apparatus according to this specific example.

Figure 28A:
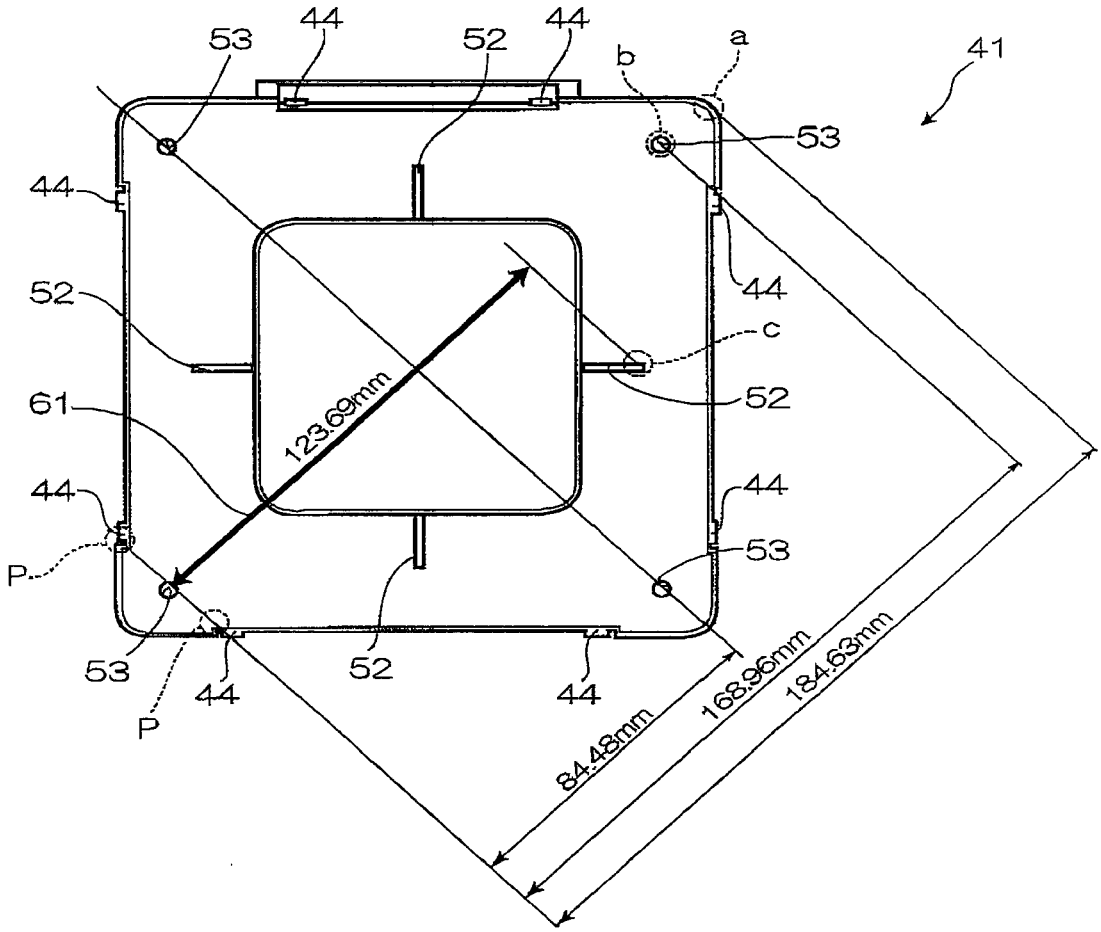
FIGS. 28A and 28B are views illustrating operation when a corner of the cover is pressed.
Figure 28B:
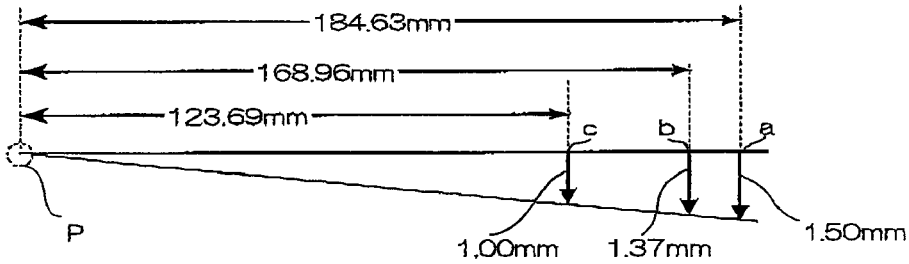

FIGS. 28A and 28B are views illustrating operation when a corner of the cover is pressed, and the FIG. 28A is a plan view schematically showing sizes of the lower panel, and the FIG. 28B is a view showing displacement amounts of the respective positions when the upper panel is sloped. FIG. 28B is a view of the upper panel viewed from the direction perpendicular to a direction 61 shown in FIG. 28A.

Figure 29A:
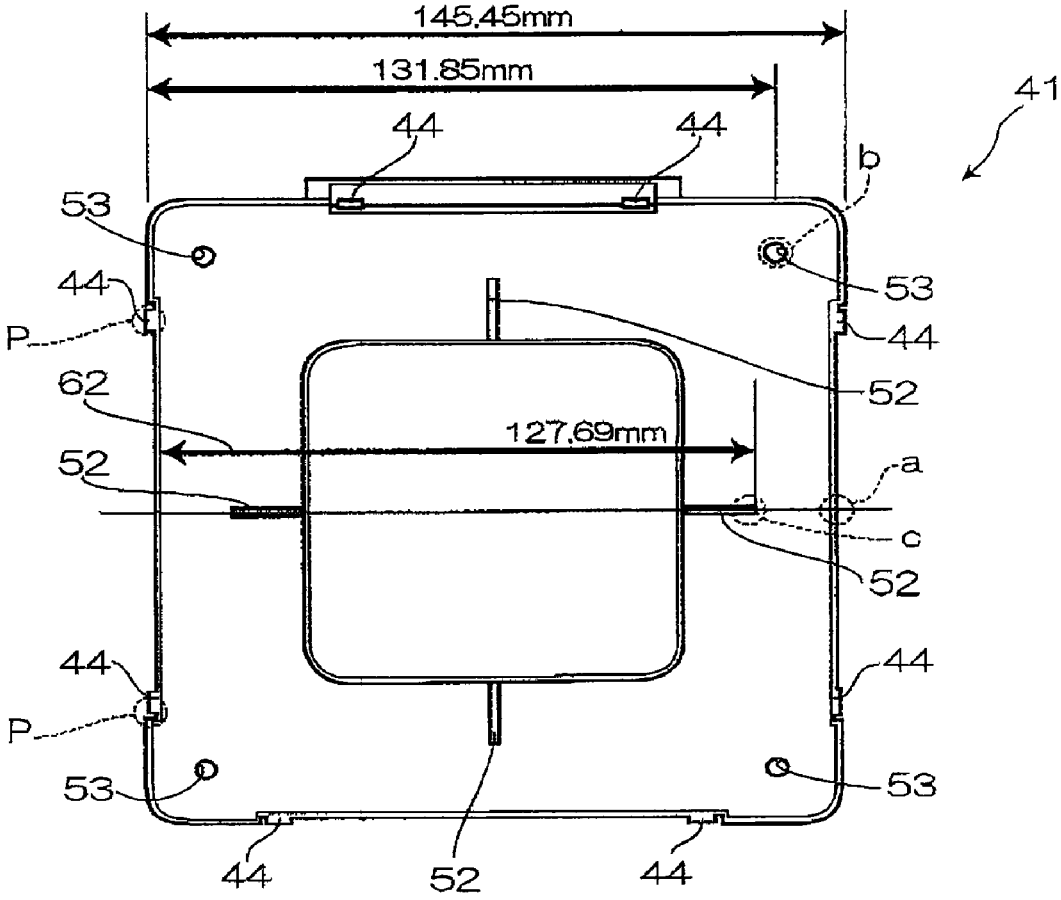
FIGS. 29A and 29B are views illustrating operation when a side of the cover is pressed.
Figure 29B:
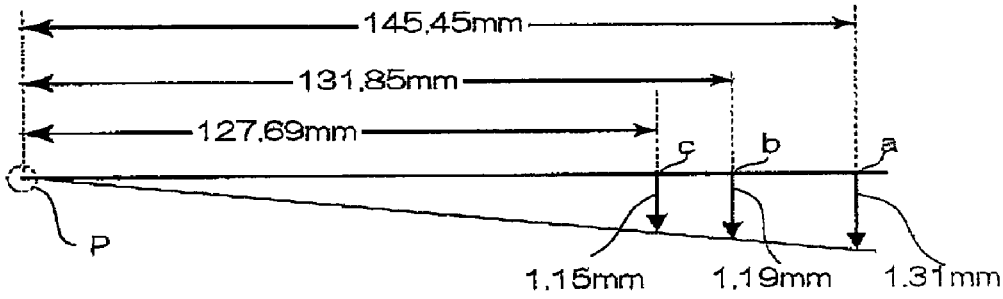

FIGS. 29A and 29B are views illustrating operation when a side of the cover is pressed, and the FIG. 29A is a plan view schematically showing sizes of the lower panel, and the FIG. 29B is a view showing displacement amounts of the respective positions when the upper panel is sloped. FIG. 29B is a view of the upper panel viewed from the direction perpendicular to the direction 62 shown in FIG. 29A.

As shown in FIG. 27, the upper panel 42 is biased to the separating direction from the lower panel 41 by the spring 54 (see FIG. 22), for example, clearance between the rib 52 of the lower panel 41 and the upper panel 42 is set to 1.15 mm and clearance between the engaging portion 44 of the lower panel 41 and the U-shaped portion 43 of the upper panel 42 is set to 1.50 mm. Moreover, as shown in FIG. 28A, viewed from front, the distance between the center of the lower panel 41 and the center of the hole 53 is set to 84.48 mm.

As shown in FIGS. 28A and 28B, when the user presses the corner of the upper panel 42 (see FIG. 27), the upper panel 42 becomes sloped along the direction 61 so that the engaging portion 44 (position p) disposed in the opposite side thereof is a support point. In this case, the upper panel 42 contacts the engaging portion 44 in the pressed corner side. Therefore, the displacement amount of the position a contacting the engaging portion 44 in the upper panel 42 is 1.50 mm. Thereby, the displacement amount of the position b provided with the projecting portion 56 becomes 1.37 mm. The displace amount of the position c corresponding to the rib 52 is 1.00 mm and smaller than the clearance (1.15 mm) of this position, and therefore, the upper panel 42 does not contact the rib 52.

On the other hand, as shown in FIGS. 29A and 29B, when the user presses a central portion of the side of the upper panel 42 (see FIG. 27), the upper panel 42 is sloped along a direction 62 so that the engaging portion 44 (position p) disposed in the opposite side thereof is a support point. In this case, the upper panel 42 contacts the rib 52 of the lower panel 41. Therefore, the displacement amount of the position c contacting the rib 52 in the upper panel 42 is 1.15 mm. Thereby, the displacement amount of the position b provided with the projecting portion 56 becomes 1.19 mm. The displace amount of the position a corresponding to the engaging portion 44 is 1.31 mm and smaller than the clearance (1.50 mm) of this position, and therefore, the upper panel 42 does not contact the engaging portion 44.

As described above, the displacement of the position b provided with the projecting portion 56 in the upper panel 42 is 1.37 mm when the corner of the upper panel 42 is pressed, and 1.19 mm when the side is pressed, and the displacement when the corner is pressed is larger. Moreover, bend amount of the whole cover 23 is larger in the case of pressing the corner of the upper panel 42, compared to the case of pressing the side. Therefore, when the user presses the corner of the upper panel 42, the projecting portion 56 pushes and switches the switch 25, but when the user presses the side, the switch 25 is not switched. Thereby, mistake operation in the case of pressing the side can be prevented. The above-described sizes are an example, and it is sufficient that the sizes of the respective parts have a relation being capable of realizing the above-described operation.

Next, operation when the switch 27 is operated will be explained.

As shown in FIGS. 17 to 20, when the user does not contact the key top 27*a*, the pressing portion 27*d* is pushed up by a reactive force of the contact point 27*b* and the locking portion 27*e* is locked by the extending portion 49*a* and the key top 27*a* is located in the end of the front side of the movement region. In this state, the contact portion 27*b* is not pushed down. On the other hand, when the user presses the key top 27*a*, the key top 27*a* moves downward against the reactive force of the contact point 27*b*, and the step 27*f* of the pressing portion 27*d* contacts the jutting portion 49*b*, and thereby, the key top 27*a* stops at the end of the rear side of the move region. In this case, the pressing portion 27*d* pushes down the contact portion 27*b* and the connective state of the contact portion 27*b* is switched. Then, when the user detaches the hand from the key top 27*a*, the key top 27*a* returns to the end of the front side by the reactive force of the contact portion 27*b*. In this case, in the region contiguous to the operated switch 27 in the display portion 26, an operation result by the switch 27 can be displayed.

And, the operation contents by the switches 25, 27, 28, and 30 are communicated to the transmission portion 31, and the transmission portion 31 transmits the control signal representing the operation contents to the sanitary cleansing apparatus or the like. Thereby, the sanitary cleansing apparatus or the like carries out the requested operation. In this case, the display portion 26 may display the operation contents.

Next, the effect of this specific example will be explained.

According to this specific example, four switches 25 can be selected and pushed in the closed state of the cover 23. Therefore, nine switches in sum total with five switches 30 provided in the upper surface of the remote control main body 22 can be operated with the closed cover 23. Thereby, the main operation of the remote control apparatus can be performed with the closed cover 23 and this is convenient, and the frequency of opening the cover 23 becomes small, and therefore, contamination of the front surface of the remote control main body 22 and the back surface of the cover 23 can be suppressed.

Moreover, according to this specific example, when the cover 23 is closed, the display portion 26 and the switches 27 are exposed from one opening portion 45 provided in the cover 23, and the switches 25 can be operated through the cover 23, and therefore, operations of high operation frequency can be performed with the closed cover 23. Furthermore, because it is sufficient to form only one opening portion in the cover 23, dust hardly accumulates in the opening portion, and cleaning in the opening portion is easy, and therefore, the cleaning property is excellent.

Furthermore, the end of the switch 27 rides the end of the display portion 26, and the front surface of the switch 27 is sloped to the front surface of the remote control main body 22, and therefore, the front surface of the display portion 26, and the front surface of the switches 27, and the front surface of the cover 23 compose an approximately continuous surface. As a result, when the remote control apparatus 21 is wiped and cleaned, catching is mall and cleaning operability is excellent. Moreover, its appearance is simple and design property is excellent.

Furthermore, in this specific example, when the user operates the switch 27, the display portion 26 can display the operation content by the switch 27, in the region contiguous to the operated switch 27. Thereby, the user can operate the switch 27 while seeing the display content of the display portion 26. In this case, because the end of the display portion 26 side of the switch 27 rides the display portion 26, the switch 27 is disposed in the extremely near position to the display portion 26, another part do not intermediate between the switch 27 and the display portion 26, and therefore, a strong sense of continuity between the display portion 26 and the switch 27 can be evoked to the user. Thereby, the user can integrally recognize the display region of the display portion 26 and the switch 27, and therefore, the operability of the switch 27 becomes extremely good.

Next, a modified example of the specific example will be explained,

First, a first modified example will be explained.

Figure 30A:
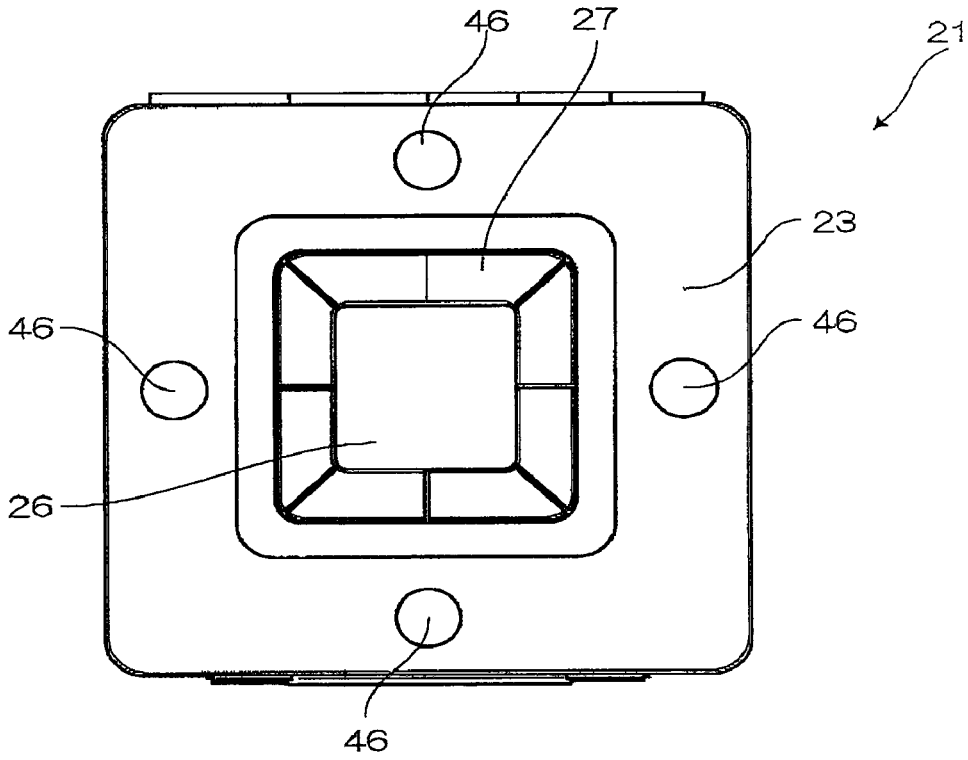
FIG. 30A is a plan view illustrating a remote control apparatus according to a first modified example.
Figure 30B:
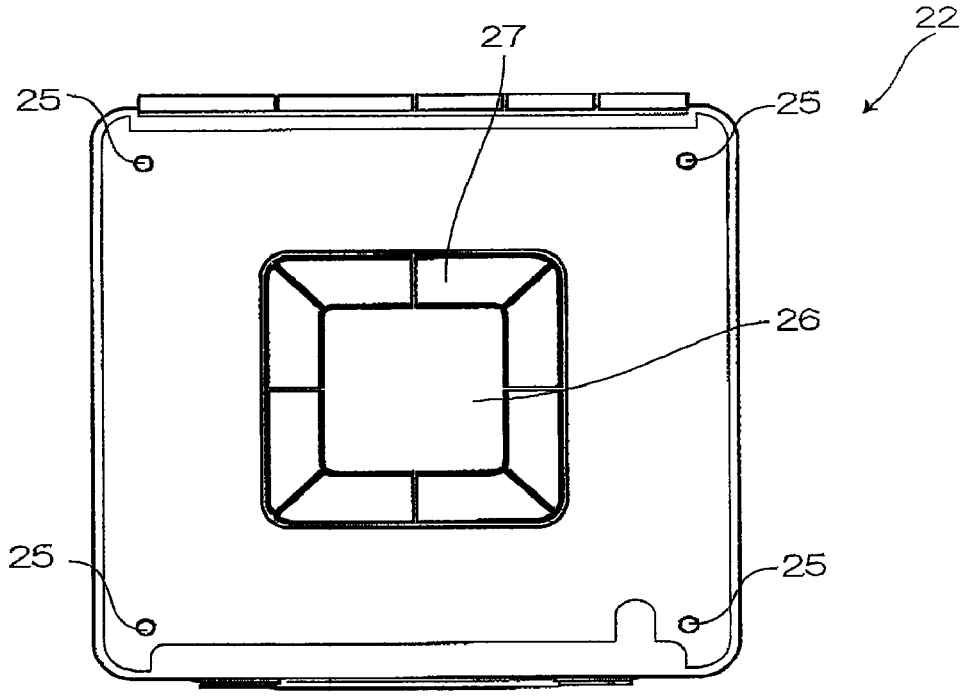
FIG. 30B is a plan view illustrating the remote control main body.

FIG. 30A is a plan view illustrating a remote control apparatus according to this modified example, and FIG. 30B is a plan view illustrating the remote control main body.

As shown in FIG. 30A, in this modified example, in the front surface of the cover 23, the concave portions 46 are formed not in the corners but in the centers of the sides. Moreover, in the cover 23, ribs 52 (see FIG. 16) are not provided. As shown in FIG. 30B, switches 25 are provided in the corners of the remote control main body 22.

In this modified example, when each of the sides of the cover 23 is pressed, two switches 25 provided in two corners sandwiching the side are operated. Moreover, when the corner of the cover 23 is pressed, only one switch 25 disposed in the corner is operated. Thereby, eight operations can be assigned to four switches 25. The structures, operations, and effects except for the above-described ones in this modified example are the same as the above-described specific example.

In this modified example, the concave portions 46 may be formed on both of the corners and the sides of the cover 23, and figures or letters or the like representing the operation contents thereof may be displayed on the respective concave portions 46. Thereby, the operability is more improved.

Next, a second modified example will be explained.

Figure 31A:
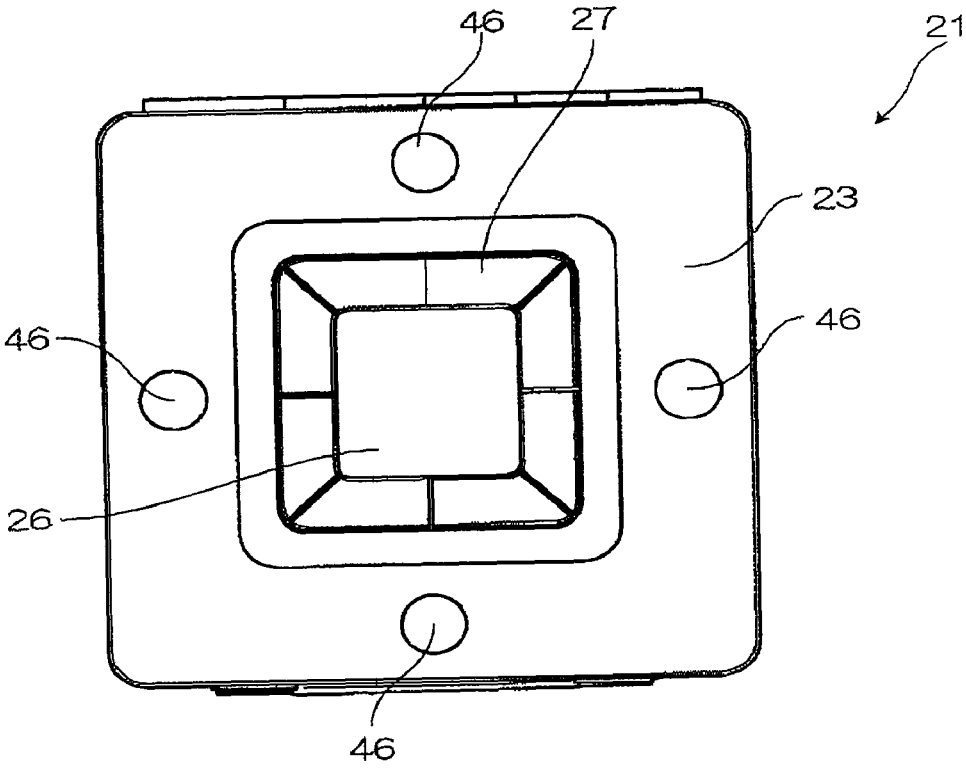
FIG. 31A is a plan view illustrating a remote control apparatus according to a second modified example.
Figure 31B:
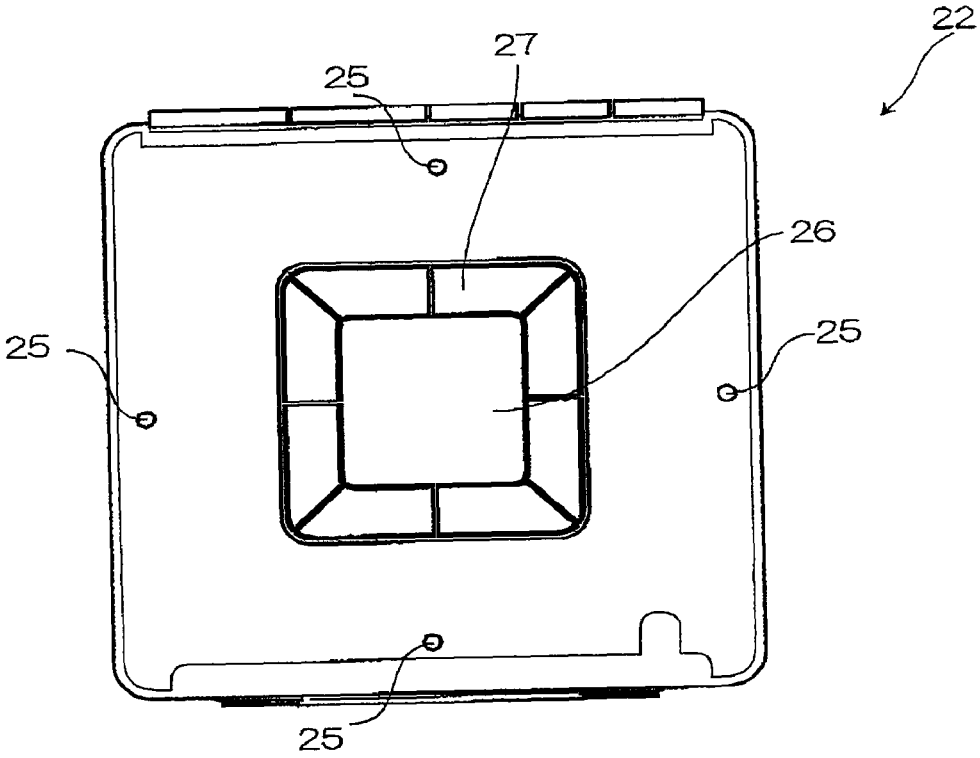
FIG. 31B is a plan view illustrating the remote control main body.

FIG. 31A is a plan view illustrating a remote control apparatus according to this modified example, and FIG. 31B is a plan view illustrating the remote control main body.

As shown in FIG. 31A, in this modified example, in the front surface of the cover 23, the concave portions 46 are formed not in the corners but in the centers of the sides. Moreover, in the cover 23, ribs 52 (see FIG. 16) are not provided. Furthermore, as shown in FIG. 31B, switches 25 are provided in the centers of the sides of the remote control main body 22.

In this specific example, when each of the sides of the cover 23 is pressed, one switch 25 disposed in the side is operated. Moreover, when the corner of the cover 23 is pressed, two switches 25 disposed in the two sides sandwiching the corner are operated. Thereby, eight operations can be assigned to four switches 25. The structures, operations, and effects except for the above-described ones in this modified example are the same as the above-described specific example.

In this modified example, ribs 52 may be formed in the corners of the cover 23. Thereby, it becomes impossible to operate two switches 25 by pressing the corner of the cover 23, but mistake operation of the switches 25 can be certainly prevented.

Next, a third modified example will be explained.

Figure 32:
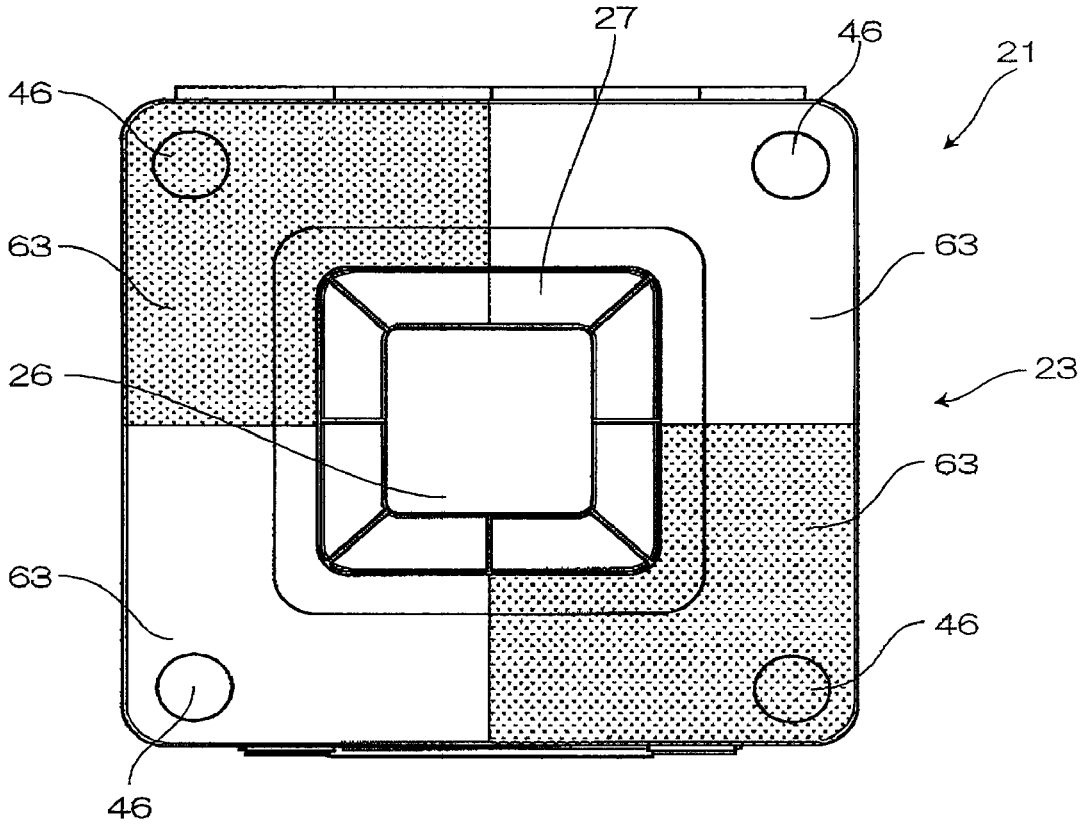
FIG. 32 is a plan view illustrating a remote control apparatus according to a third modified example.

FIG. 32 is a plan view illustrating a remote control apparatus according to this modified example.

As shown in FIG. 32, in this modified example, the front surface of the cover 23 are color-coded to four regions 63 containing the respective corners of the cover 23. Each of the regions 63 corresponds to a pressing region that is pressed to be capable of forcing the projecting portion 56 disposed in the region 63 to press the switch 25. And, each of the regions 63 is color-coded with different color from that of the region contacting this region 63 in the front surface of the cover 23. The color-coding method includes a method using colorant, a method using light source, and a method using phosphorescent substance. Thereby, when a user desires to operate a special switch 25, the region to be pressed in the cover 23 can be recognized at one view, the operability is improved. This effect is effective for a user having poor vision such as aged person. The structures, operations, and effects except for the above-described ones in this modified example are the same as the above-described specific example. In FIG. 32, the example in which the regions 63 contact each other, but the regions between the regions 63 may be color-coded with another color.

Next, a fourth modified example will be explained.

Figure 33:
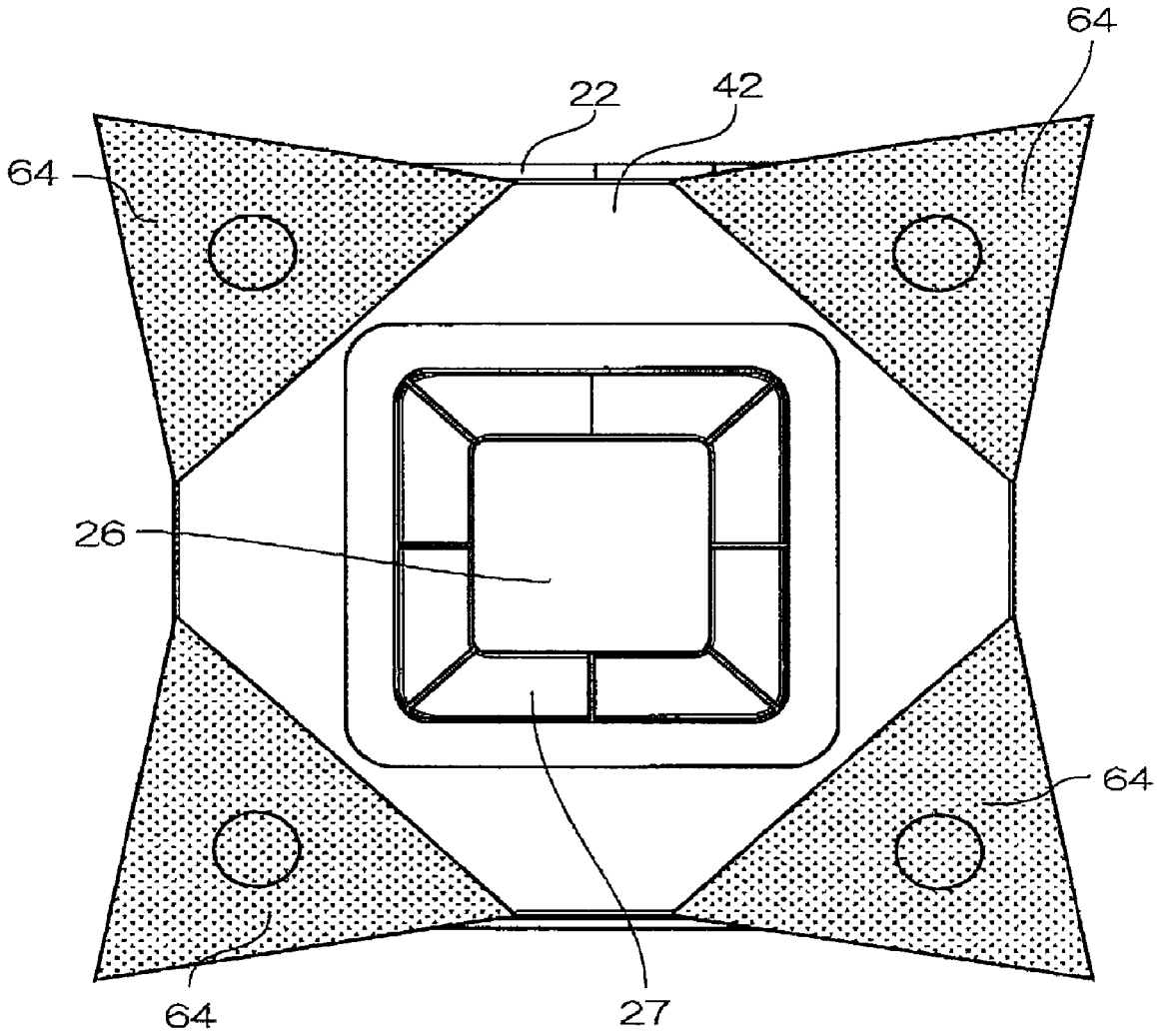
FIG. 33 is a plan view illustrating a remote control apparatus according to a fourth modified example.

FIG. 33 is a plan view illustrating a remote control apparatus according to this modified example.

As shown in FIG. 33, in this modified example, viewed from front, the portions corresponding to the corners in the cover 23 protrudes from the outer edge of the remote control main body 22. Thereby, viewed from front, the pressing region in the front surface of the cover 23, namely, a part of the region 64 that is capable of forcing each of the projecting portions 56 to press the switch 25 is set in the position protruding from the remote control main body 22. Moreover, in the example shown in FIG. 33, the regions 64 are color-coded with a different color from the region except for the regions 64.

As a result, when a user desires to operate a special switch 25, the region to be pressed in the cover 23 is large, and the operability is improved. This effect is effective for a user having poor vision such as aged person. The structures, operations, and effects except for the above-described ones in this modified example are the same as the above-described specific example.

In FIG. 33, the shape of the region 64 is triangle but is not limited thereto, and may be a shape industrially designed such as, polygon such as quadrangle or pentagon, polygon whose corners rounded off, circle or ellipse, or heart shape.

Next, a second specific example will be explained.

This second specific example is a specific example of the above-described remote control apparatus according to the sixth embodiment, namely, the remote control apparatus of type that the cover bends to be displaced.

Figure 34:
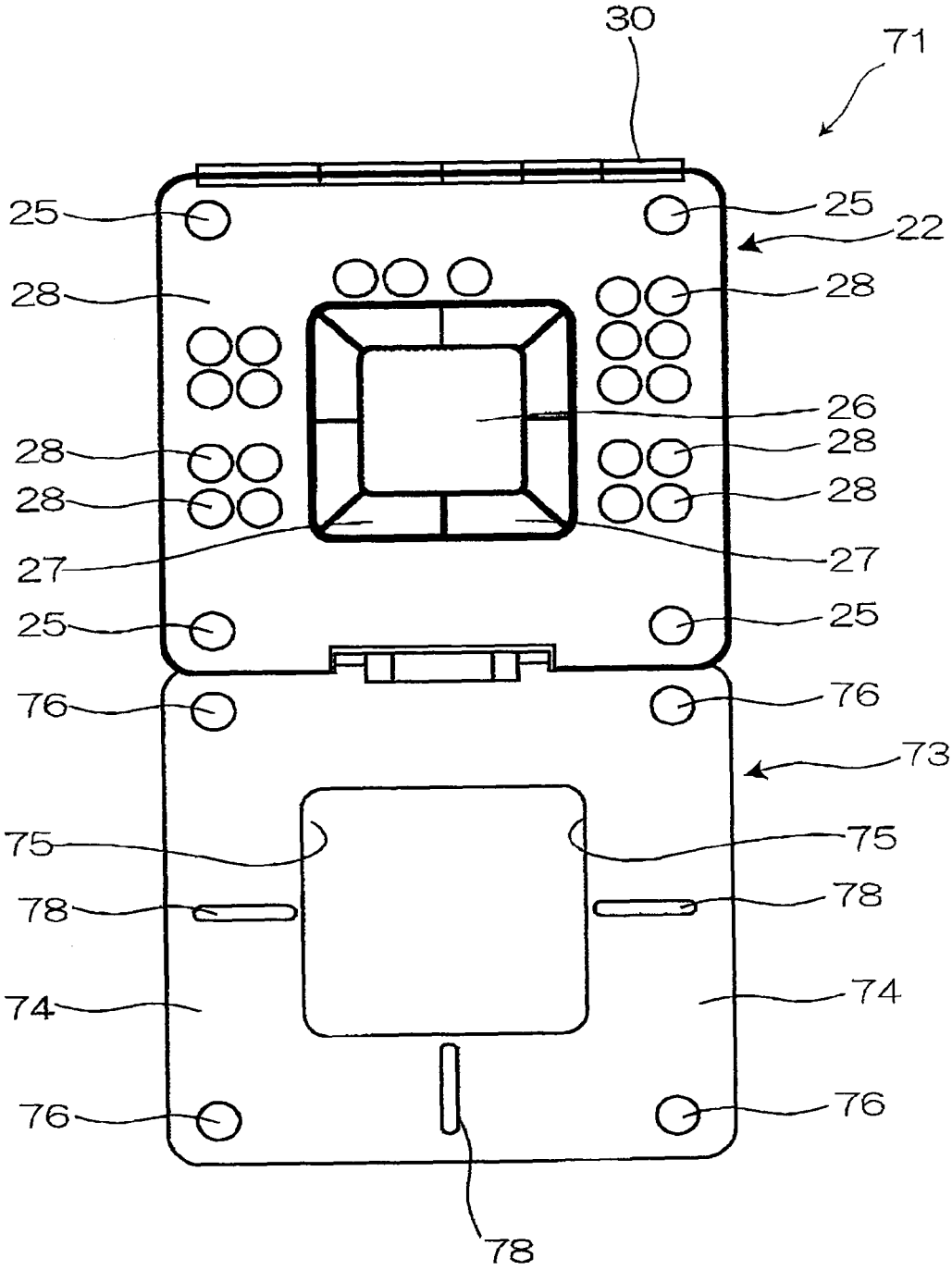
FIG. 34 is a front view illustrating a remote control apparatus according to the second specific example and shows a state that the cover is opened.
Figure 35:
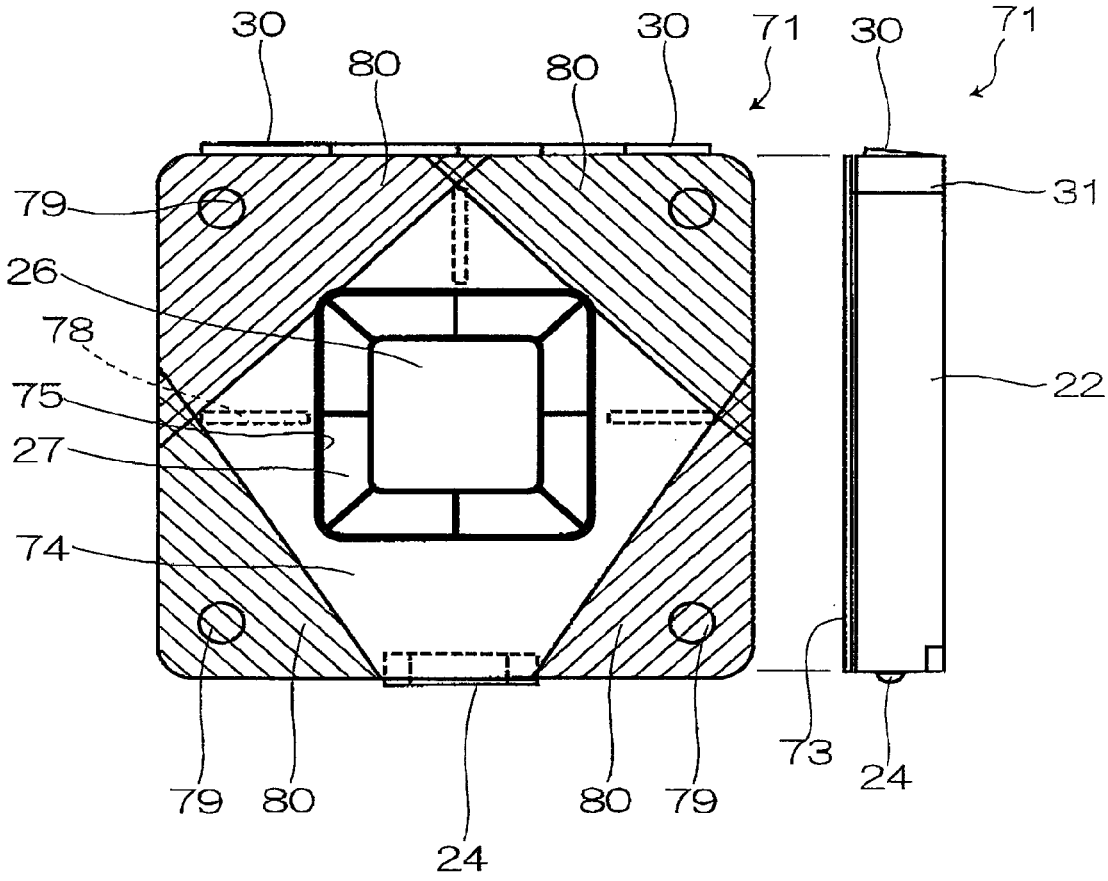
FIG. 35 is a front view and side view illustrating the remote control apparatus according to the second specific example and shows a state that the cover is closed.

FIG. 34 is a front view illustrating a remote control apparatus according to this specific example and shows a state that the cover is opened, FIG. 35 is a front view and side view illustrating the remote control apparatus according to this specific example and shows a state that the cover is closed.

In FIG. 35, the regions bending with being pressed are represented by diagonal lines. Moreover, in FIGS. 34 and 35, with respect to various letters and figures printed in the remote control apparatus, illustration is omitted.

As shown in FIGS. 34 and 35, in a remote control apparatus 71, the cover 73 is connected rotatably to the remote control main body 22 through the hinge 24. The structure of the remote control main body 22 is the same as the above-described first specific example (see FIGS. 10 to 29).

In the cover 73, for example, a resin plate 74 made of ABS resin and having a thickness of 1.5 millimeter is provided, and in the center of the resin plate 74, an opening portion 75 is formed. The opening portion 75 is located in the region matched to the display portion 26 and the switches 27 of the remote control main body 22 and exposes the display portion 26 and the switches 27.

Moreover, domed projections 76 are formed at four corners on the back surface of the resin plate 74, namely, on the surface to be in the remote control main body 22 side when the cover 73 is closed. The projections 76 are, for example, made of the same resin as the resin forming the resin plate 74 and formed integrally with the resin plate 74. The projections 76 are formed in the positions matched to the switches 25 of the remote control main body 22 when the cover 73 is closed.

Furthermore, around the opening portion 75 on the back surface of the resin plate 74, three ribs 78 extending radially to the outer edge of the resin plate 74 from the vicinity of the opening portion 75 are provided. Each of the three ribs 78 extends linearly from the vicinity of the opening portion 75 to the central portion of three sides except for the side to which the hinge 24 is connected in the resin plate 74. The ribs 78 is, for example, made of the same resin as the resin forming the resin plate 74 and formed integrally with the resin plate 74. That is, the ribs 78 are provided in the region between the projections 76 and located between the switches 25 when the cover 73 is closed. Furthermore, concave portions 79 are formed in the corners of the front surface of the 74, namely, in the region corresponding to the projection 76. The structures except for the above-described ones in this specific example are the same as the above-described first specific example.

Next, the operation of the remote control apparatus according to this specific example will be explained.

When the cover 73 is closed and a user does not touch the cover 73, the cover 73 is disposed approximately in parallel to the front surface of the remote control main body 22, and the projection 76 of the cover 73 does not press the switch 25 of the remote control main body 22.

In this state, when the user presses the concave portion 79 or the vicinity thereof in the resin plate 74 to the rear, the region containing the pressed concave portion 79 out of regions 80 represented by the diagonal lines in FIG. 35 bends to the rear. In this case, the rib 78 of the resin plate 74 contacts the front surface of the remote control main body 22 and the resin plate 74 transforms so that the rib 78 is a support point. And, the projection 76 formed in the bending region 80 moves to the rear and contacts the facing switch 25 and press the switch.

In this case, because the rib 78 is provided between the projections 76, movement to the rear of the portion provided with the rib 78 in the resin plate 74 is regulated. Moreover, the rib 78 is not provided in the side to which the hinge 24 is connected in the resin plate 74, but the movement to the rear of the central portion of the side is regulated by the hinge 24. Thereby, when one concave portion 79 is pressed, the deformation of the regions 80 except for the region 80 containing this concave portion 79 can be prevented. Therefore, the projections 76 except for the projection 76 corresponding to the pressed concave portion 79 does not press the switch 25 and when one point of the resin plate 74 is pressed, two or more switches 25 are not operated. As a result, the user can select and push four switches 25 from above of the cover 73.

On the other hand, when the user detached the hand from the resin plate 74, the resin plate 74 returns to be in the original shape by its elastic force and the projection 76 separates from the switches 25.

According to this specific example, compared to the above-described first specific example, the structure of the cover can be simplified. The operations and effects except for the above-described ones in this embodiment are the same as the above-described first specific example.

Next, a seventh embodiment of this invention will be explained.

In this embodiment, examples in which the above-described remote control apparatuses according to the respective embodiments or their specific examples or their modified examples are applied to a toilet apparatus will be explained.

Figure 36:
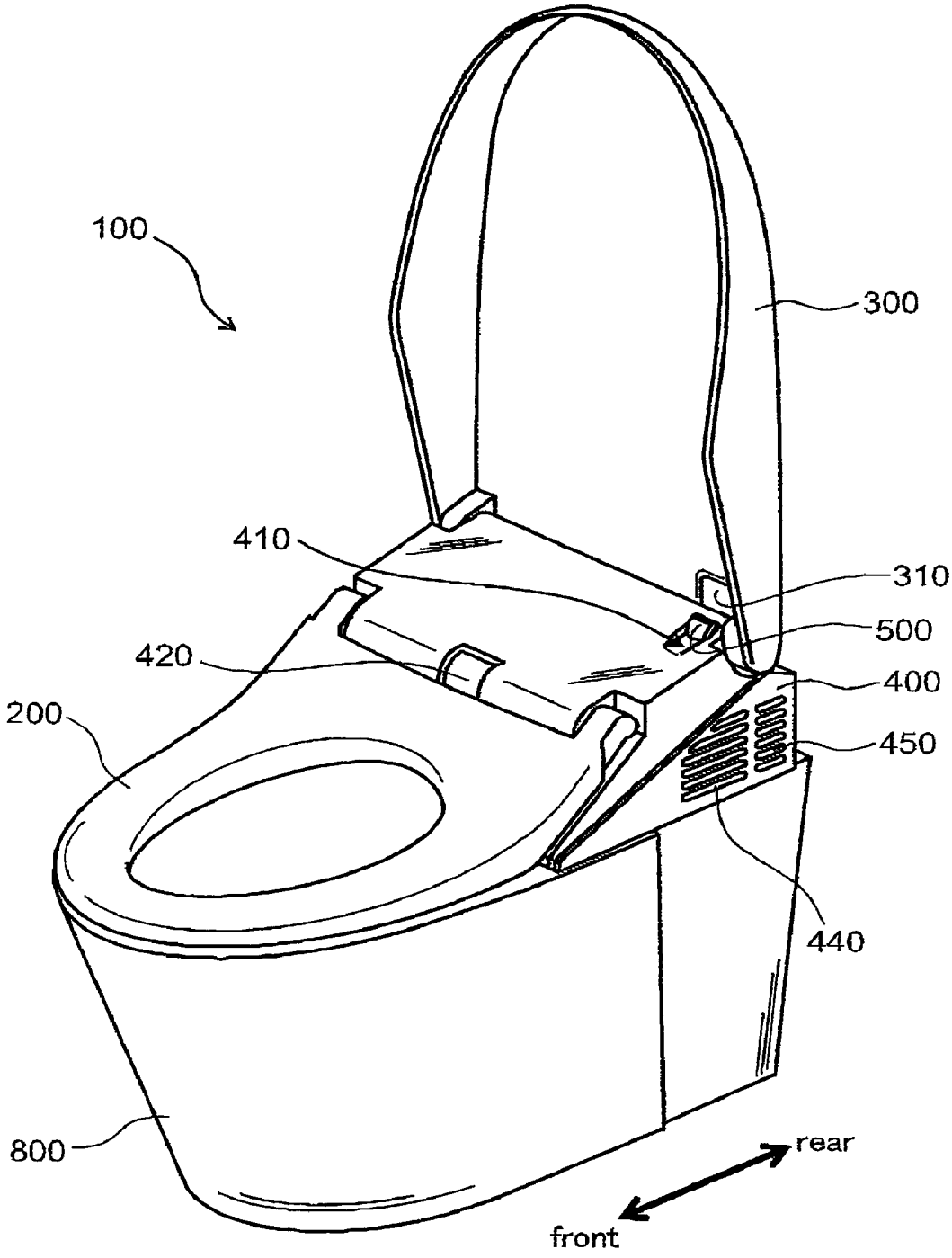
FIG. 36 is a schematic perspective view illustrating appearance of the toilet apparatus that can be operated by the remote control apparatus according to this embodiment of the invention.

FIG. 36 is a schematic perspective view illustrating appearance of the toilet apparatus that can be operated by the remote control apparatus according to the embodiment of this invention.

As shown in FIG. 36, the toilet apparatus includes a western-style sit-down toilet bowl 800 and a sanitary cleansing apparatus 100 provided thereon. The sanitary cleansing apparatus 100 has a main body 400, the toilet seat 200, and a toilet lid 300. The toilet seat 200 and the toilet lid 300 are pivotally supported openably with respect to the main body 400

The main body 400 houses a sanitary cleansing function part for realizing sanitary cleansing therein. That is, a seating sensor 420 detects that a user sits down on the toilet seat 200, and a water discharge nozzle (not shown) is advanced into the bowl of the toilet bowl 800 from the main body 400 according to switching operation or the like by the user, and water is squirted from a water discharge hole provided in the vicinity of the tip end thereof, and thereby, the "derriere" or the like of the user sitting down on the toilet seat can be cleansed. "Water" in this specification is referred to as heated hot water as well as cold water.

In this embodiment, a recessed portion 410 is formed on the upper surface of the main body portion 400, and a human body detection sensor 500 is provided so that a part thereof is buried into the recessed portion. The human body detection sensor 500 detects the existence of the user through a transparent window 310 provided in the vicinity of the base in the when the toilet lid is closed.

Moreover, in the main body portion 400, various mechanisms such as "warm air dry unit", "deodorization unit" or "indoor heating unit" are appropriately provided, and in the side surface thereof, exhaust ports 440 and ejection holes 450 are appropriately provided. Moreover, there can be provided "automatic opening and closing function" by which the toilet lid 300 is automatically opened with detecting approach of the user and the toilet lid 300 is automatically closed when the user passes away. Furthermore, "automatic flushing function" of flowing flushing water into the toilet bowl 800 may be attached to the sanitary cleansing apparatus 100. This is the function that a drive mechanism for operating a drainage mechanism such as a low tank or a flush valve is provided and a signal for operating the drive mechanism is output from the main body 400 to automatically flow the flushing water into the toilet bowl 800.

These functions can be carried out and set by appropriately operating an operation portion (not shown) provided with the main body 400, and also can be carried out by operating a remote control (not shown) provided on a wall surface or the like of the toilet. And, in this embodiment, as the remote control apparatus, the remote control apparatus described above about FIGS. 1 to 33 is used, and thereby, excellent cleaning property, operability, design property, or the like can be obtained and a comfortable toilet room can be provided.

As described above, the embodiments of this invention have been explained with reference to specific examples. However, this invention is not limited to these embodiments and their specific examples. For example, the profile of the remote control apparatus is not limited to the square whose corners are rounded off but can be a discretional shape, and its arrangement position is not limited to the central portion of the cover. Furthermore, opening and closing operation of the cover is not limited to the specifically explained opening and closing operation so that the hinge is the center but the cover having a shape to which this invention can be applied such as a type of the cover for performing opening and closing with be slid is possible. Furthermore, communication between the remote control apparatus and the sanitary cleansing apparatus or the like is not limited to one-way communication from the remote control apparatus to the sanitary cleansing apparatus or the like but the two-way communication enabling the communication from the sanitary cleansing apparatus or the like to the remote control apparatus is also possible. Thereby, for example, the state of the sanitary cleansing apparatus or the like can be displayed in the display portion of the remote control apparatus. In this case, the control signal transmitted and received between the remote control apparatus and the sanitary cleansing apparatus or the like is not limited to the infrared process but may utilize a radio wave having another wavelength and may utilize supersonic wave, or it is also possible to transmit and receive electric signal by wired system. Furthermore, the electric power for driving the remote control apparatus may be supplied by a housed battery or may be supplied from a household electric source.

Furthermore, such a technique as so-called "double function" in which the different functions are exerted by the switch 25 in the closed state and opened state of the cover is combined, and thereby, a further wide variety of switch operation can be realized. Moreover, a technique in which the switch to be pressed with the cover can be operated only in the closed state of the cover and in which the switch to be pressed with the cover is cancelled in the opened state of the cover can be combined.

Moreover, the above-described embodiments, specific examples, and modified examples can be discretionally combined in the technically possible range, and a remote control apparatus obtained by such a combination is also included in the range of this invention as long as including the scope of this invention. Furthermore, in the above-described respective embodiments, examples in which the remote control apparatus is a remote control apparatus for electric hardware such as a sanitary cleansing apparatus mounted on a toilet apparatus is illustrated but this invention is not limited thereto but is applied to a remote control apparatus for various electric hardware.

Industrial Applicability

According to this invention, there can be realized a remote control apparatus in which, the main operation buttons and the display portion are visible in the closed state of the cover, the operability is excellent, and the cleaning operability is excellent.

Alternatively, according to this invention, a remote control apparatus by which a plurality of switches can be operated in the state of being covered with the cover can be realized.

The invention claimed is:

1. A remote control apparatus for operating electronic hardware, comprising:

a remote control main body;

a cover covering a front surface of the remote control main body;

a plurality of switches provided on at least one of the remote control main body or the cover and switching by pressing force;

a bias means for making bias in a direction that a portion of the cover or the remote control main body contacting the switch when the switch is pressed and the switch are separated from each other; and a regulation means for regulating movement to the direction that the contacting portion and the switch are separated from each other, and thereby, maintaining a distance between the contacting portion and the switch to be constant with the bias means, the cover being openably attached to the remote control main body and covering the front surface of the remote control main body when closed and exposing the front surface when opened, one part of the cover being pressed to the remote control main body in the closed state of the cover and thereby being displaced to the remote control main body, and by the displacement, the cover or the remote control main body pressing any one of the plurality of switches, and another part of the cover being pressed to the remote control main body in the closed state of the cover and thereby being displaced to the remote control main body, and by the displacement, the cover or the remote control main body pressing another one of the plurality of switches.

2. The remote control apparatus according to claim 1, wherein the cover includes:

a lower panel positioned with respect to the remote control main body when the cover is closed; and an upper panel superposed in an opposite side from the remote control main body if viewed from the lower panel when the cover is closed, and supported by the lower panel, the bias means being disposed between the lower panel and the upper panel.

3. The remote control apparatus according to claim 2, wherein the switch is provided on the remote control main body, and a part of the upper panel contacts the switch when the cover is pressed.

4. The remote control apparatus according to claim 2, wherein the switch is provided on the upper panel, and a part of the remote control main body contacts the switch when the cover is pressed.

5. The remote control apparatus according to claim 2, wherein the switch is provided on one of the upper panel and the lower panel, and a part of the other of the upper panel and the lower panel contacts the switch when the cover is pressed.

6. The remote control apparatus according to claim 1, wherein the switch is provided on the remote control main body, and the cover is pressed to the remote control main body and thereby at least a part of the cover bends to the remote control main body and a portion displaced by the bending contacts the switch to press the switch.

7. The remote control apparatus according to any one of claims 3 to 6, wherein in a portion contacting the switch when the cover is pressed, a projection is formed.

8. The remote control apparatus according to claim 1, further comprising a rib provided in a region between the switches and locally regulating displacement of the cover to the remote control main body.

9. The remote control apparatus according to claim 1, wherein the remote control main body includes:

a display portion provided on a front surface of the remote control main body and displaying an operation content; and the plurality of switches, the cover including an opening portion for exposing the display portion when closed.

10. The remote control apparatus according to claim 9, wherein an outer edge of the remote control main body and the cover forms a polygon when viewed from front, and a switch operation means is provided in a corner of the polygon.

11. The remote control apparatus according to claim 10, wherein a press region being capable of pressing the switch by pressing a front surface of the cover juts out from the remote control main body when viewed from front.

12. The remote control apparatus according to claim 9, wherein an outer edge of the remote control main body and the cover forms a polygon when viewed from front, and the switch operation means is provided in a side of the polygon.

13. The remote control apparatus according to claim 9, wherein the remote control main body further includes another switch which is disposed around the display portion and whose end rides on an end of the display portion, and the opening portion of the cover exposes the another switch as well as the display portion when the cover is closed.

* * * * *